US007959336B2

(12) United States Patent
Iwasaki

(10) Patent No.: US 7,959,336 B2
(45) Date of Patent: Jun. 14, 2011

(54) VEHICLE LIGHTING DEVICE

(75) Inventor: Kazunori Iwasaki, Tokyo (JP)

(73) Assignee: Ichikoh Industries, Ltd., Tokyo (JP)

( * ) Notice: Subject to any disclaimer, the term of this patent is extended or adjusted under 35 U.S.C. 154(b) by 278 days.

(21) Appl. No.: 12/403,778

(22) Filed: Mar. 13, 2009

(65) Prior Publication Data

US 2009/0284981 A1 Nov. 19, 2009

(30) Foreign Application Priority Data

May 14, 2008 (JP) ..... 2008-127099

(51) Int. Cl.
*F21V 7/09* (2006.01)

(52) U.S. Cl. ..... 362/517; 362/518; 362/519; 362/538; 362/543; 362/544; 362/297; 362/298; 362/243; 362/247

(58) Field of Classification Search ..... 362/507–508, 362/514, 516–519, 538–539, 543–545, 241–246, 362/296.01, 297, 299, 300, 302–303, 236–237, 362/243, 245, 249.02, 298
See application file for complete search history.

(56) References Cited

U.S. PATENT DOCUMENTS

2004/0022067 A1 2/2004 Taniuchi
2004/0228139 A1 11/2004 Taniuchi

FOREIGN PATENT DOCUMENTS

EP 1 528 313 A2 5/2005
EP 1 705 422 A1 9/2006
JP 2006-019052 A 1/2006
JP 2008-41557 A 2/2008

OTHER PUBLICATIONS

U.S. Appl. No. 12/403,764, filed Mar. 13, 2009, Iwasaki.
K. Iwasaki, U.S. PTO Office Action, U.S. Appl. No. 12/403,764, dated Dec. 22, 2010, 9 pages.

*Primary Examiner* — Robert May
(74) *Attorney, Agent, or Firm* — Foley & Lardner LLP

(57) ABSTRACT

A vehicle lighting device includes: a lamp unit for concentrating light; a lamp unit for diffusion; a lamp housing and a lamp lens, partitioning a lamp room; and an optical-axis adjuster which is integrally mounted in the lamp housing in an optical-axis adjustable manner in a state in which the lamp unit for concentrating light and a lamp unit for diffusion are integrally disposed in the lamp room. The lamp unit for concentrating light radiates a light distribution pattern for diffusion. The lamp unit for diffusion radiates a light distribution pattern for diffusion. As a result, in this vehicle lighting device, one lamp unit for concentrating light is provided which satisfies a main light distribution standard and forms a light distribution pattern for concentrating light as a standard for optical axis, thereby facilitating adjustment of light distribution and allowing for precise adjustment of light distribution.

4 Claims, 15 Drawing Sheets

VEHICLE LIGHTING DEVICE

CROSS-REFERENCE TO RELATED APPLICATIONS

The present application claims priority to and incorporates by reference the entire contents of Japanese priority document 2008-127099 filed in Japan on May 14, 2008.

BACKGROUND OF THE INVENTION

1. Field of the Invention

The present invention relates to a vehicle lighting device employing a semiconductor-type light source as a light source and having a plurality of reflecting surfaces.

2. Description of the Related Art

A vehicle lighting device of this type is conventionally disclosed in Japanese Laid-open Patent Application No. 2008-41557, for example. Hereinafter, the conventional vehicle lighting device will be explained. The conventional vehicle lighting device is provided with a semiconductor-type light source, a first reflecting surface, a second reflecting surface, a third reflecting surface, and a fourth reflecting surface. Hereinafter, effects of the conventional vehicle lighting device will be explained. First, the semiconductor-type light source is intended to illuminate and emit light. Part of light radiated from the semiconductor-type light source is then reflected by the first reflecting surface. Part of the reflected light is reflected by the third reflecting surface, and is radiated on a road surface, as a light distribution pattern having a horizontal cut-line on an upper edge. In addition, the remainder of the reflected light from the first reflecting surface is mainly reflected by the second reflecting surface, and is radiated on a road surface, as a light distribution pattern having a hot spot portion superimposed in the light distribution pattern and a protrusive portion including an oblique cut-line projecting upwardly of the horizontal cut-line. Further, the remainder of the light radiated from the semiconductor-type light source is mainly reflected by the fourth reflecting surface, and is radiated on an overhead sign or the like, as an overhead sign light distribution pattern. In this manner, in the conventional vehicle lighting device, an ideal light distribution pattern can be obtained by one lamp unit.

A problem to be solved by the invention is to improve the conventional vehicle lighting device described previously.

SUMMARY OF THE INVENTION

The invention according to a first aspect is characterized by a vehicle lighting device, including: a lamp unit for concentrating light; a lamp unit for diffusion; a lamp housing and a lamp lens, partitioning a lamp room; and an optical-axis adjuster which is integrally mounted in the lamp housing in an optical-axis adjustable manner in a state in which the lamp unit for concentrating light and the lamp unit for diffusion are integrally disposed in the lamp room, wherein the lamp unit for concentrating light is comprised of: a first reflecting surface which is an elliptical reflecting surface; a semiconductor-type light source disposed at or near a first focal point of the first reflecting surface; and a parabolic reflecting surface for controlling reflected light from the first reflecting surface and reflecting the controlled reflected light on a road surface, as a light distribution pattern for concentrating light, and wherein: the lamp unit for diffusion is comprised of: a first reflecting surface which is an elliptical reflecting surface; a semiconductor-type light source disposed at or near a first focal point of the first reflecting surface; and a parabolic reflecting surface for controlling reflected light from the first reflecting surface and reflecting the controlled reflected light on a road surface, as a light distribution pattern for diffusion.

According to the invention of the first aspect, a light distribution pattern for concentrating light is formed which satisfies a main light distribution standard by a lamp unit for concentrating light and which is a standard for an optical axis, and a light distribution pattern for diffusion is formed which improves marketability by a lamp unit for diffusion. As a result, in the vehicle lighting device of the present invention, one lamp unit for concentrating light is provided which forms a light distribution pattern for concentrating light, the pattern satisfying a main light distribution standard and becoming a standard for an optical axis, thereby facilitating adjustment of light distribution and allowing for precise adjustment of light distribution. In particular, the vehicle lighting device of the present invention facilitates adjustment of light distribution and allows for precise adjustment of light distribution. Thus, the device is effective in cases where a horizontal cutoff line and an oblique cutoff line are present in a light distribution pattern for concentrating light formed by one lamp unit for concentrating light and where a horizontal cutoff line is present in a light distribution pattern for diffusion formed by a lamp unit for diffusion. In other words, it is effective to define the horizontal cutoff line and the oblique cutoff line of the light distribution pattern for concentrating light as a standard because it is possible to prevent misidentification between the horizontal cutoff line and the oblique cutoff line of the light distribution pattern for concentrating light and the horizontal cutoff line of the light distribution pattern for diffusion and to prevent stray light exerted by misidentification of the cutoff lines.

The invention according to a second aspect is characterized in that: the lamp unit for concentrating light is positioned inside of a vehicle relative to the lamp unit for diffusion.

In the invention according to the second aspect, as shown in FIG. 12, a lamp unit 1 for concentrating light is positioned inside of a vehicle relative to a lamp unit 101 for diffusion. Thus, this lamp unit 1 is effective in a case where an obstacle such as an inner panel 33 exists inside of the vehicle. In other words, the widening range W1 of the light distribution pattern SP for concentrating light, radiated from the lamp unit 1 for concentrating light, is narrower than the widening range W2 of the light distribution pattern WP for diffusion, radiated from the lamp unit 101 for diffusion. Thus, the light distribution pattern SP for concentrating light, radiated from the lamp unit 1 for concentrating light, and the light distribution pattern WP for diffusion, radiated from the lamp unit 101 for diffusion, are never interrupted by an obstacle such as the inner panel 33 positioned inside of the vehicle. Therefore, the widening range W1 of the light distribution pattern SP for concentrating light, radiated from the lamp unit 1 for concentrating light, and the widening range W2 of the distribution pattern WP for diffusion, radiated from the lamp unit 101 for diffusion, are never narrowed by an obstacle such as the inner panel 33 positioned inside of the vehicle. Conversely, as shown in FIG. 13, the lamp unit 101 for diffusion may be positioned inside of the vehicle relative to the lamp unit 1 for concentrating light. In this case, the light distribution pattern SP for concentrating light, radiated from the lamp unit 1 for concentrating light, is never interrupted by an obstacle such as the inner panel 33 positioned inside the vehicle, whereas the light distribution pattern WP for diffusion, radiated from the lamp unit 101 for diffusion, is thereby interrupted. Therefore, the widening range W1 of the light distribution pattern SP for concentrating light, radiated from the lamp unit 1 for concentrating light, is never narrowed by an obstacle such as the inner panel 33 positioned inside of the vehicle, whereas the widening range W3 of the light distribution pattern WP for diffusion, radiated from the lamp unit 101 for diffusion, is narrowed by a range W4 interrupted by an obstacle such as the inner panel 33 positioned inside of the vehicle. In other words, W3=W2−W4 is established. For example, even if the light distribution pattern SP for concentrating light, radiated from the lamp unit 1 for concentrating light, positioned inside of the vehicle, is interrupted by an obstacle such as the inner panel 33 positioned inside of the vehicle, a range (not shown) in which the light distribution pattern SP for concentrating light is interrupted becomes narrower than the range W4 in which the light distribution pattern WP for diffusion, radiated from the lamp unit 101 for diffusion, positioned inside of the vehicle, is interrupted by an obstacle such as the inner panel 33 positioned inside of the vehicle. Even if the light distribution pattern WP for diffusion, radiated from the lamp unit 101 for diffusion, positioned outside of the vehicle, is interrupted by an obstacle such as the inner panel 33 positioned inside of the vehicle, the range (not shown) in which the light distribution pattern WP for diffusion is interrupted becomes narrower than the range W4 in which the light distribution pattern WP for diffusion, radiated from the lamp unit 101 for diffusion, positioned inside of the vehicle, is interrupted by an obstacle such as the inner panel 1 positioned inside of the vehicle. This narrowing is effective because it is possible to narrow the range of the light distribution pattern SP for concentrating light, interrupted by an obstacle such as the inner panel 33 positioned inside of the vehicle, and the range of the light distribution pattern WP for diffusion, and it is possible to improve efficiency of light distribution accordingly.

The invention according to a third aspect is characterized in that: the lamp unit for concentrating light comprises: a shade which is provided at or near a second focal point of the first reflecting surface and cuts off part of reflected light from the first reflecting surface; a shade reflecting surface which is provided on the shade and reflects on the parabolic reflecting surface the part of the reflected light from the first reflecting surface, the reflected light being cut off by the shade; and the parabolic reflecting surface, a focal point of which is positioned at or near the second focal point of the first reflecting surface and which controls the reflected light from the first reflecting surface and the reflected light from the shade reflecting surface and reflects the controlled reflected light on a road surface, as the light distribution pattern for concentrating light having a horizontal cutoff line and an oblique cutoff line, and wherein the lamp unit for diffusion comprises: a shade which is provided at or near a second focal point of the first reflecting surface and cuts off part of reflected light from the first reflecting surface; a shade reflecting surface which is provided on the shade and reflects on the parabolic reflecting surface the part of the reflected light from the first reflecting surface, the reflected light being cut off by the shade; and the parabolic reflecting surface, a focal point of which is positioned at or near the second focal point of the first reflecting surface and which controls the reflected light from the first reflecting surface and the reflected light from the shade reflecting surface and reflects the controlled reflected light on a road surface, as the light distribution pattern for concentrating light having a horizontal cutoff line.

In the invention according to the third aspect, part of the reflected light from the first reflecting surfaces of the lamp units for concentrating light and for diffusion is cut off by a shade, so that the light distribution pattern for concentrating light, having the horizontal cutoff line and the oblique cutoff line, and the light distribution pattern for diffusion having the horizontal cutoff line, i.e., the light distribution pattern for passing, having the horizontal cutoff line and the cutoff line, can be easily controlled by the parabolic reflecting surfaces of the lamp unit for concentrating light and the lamp unit for diffusion. Moreover, in the vehicle lighting device of the present invention, part of the reflected light from the first reflecting surface cut off by the shade is reflected by the parabolic reflecting surface by means of the shade reflecting surface, so that the light radiated from the semiconductor-type light source can be effectively utilized. Therefore, in the vehicle device of the present invention, an ideal light distribution pattern for passing can be obtained by one lamp unit for concentrating light and one lamp unit for diffusion, thus making it possible to contribute to traffic safety.

The invention according to a fourth aspect is characterized in that: the horizontal cutoff line of the light distribution pattern for diffusion is set lower than the horizontal cutoff line of the light distribution pattern for concentrating light.

In the invention according to the fourth aspect, the horizontal cutoff line of the light distribution pattern for diffusion is set lower than that of the light distribution pattern for concentrating light. Thus, even in a case where production tolerance occurs with constituent elements of the vehicle lighting device, the horizontal cutoff line of the light distribution pattern for diffusion is never upper than that of the light distribution pattern for concentrating light, thus improving the yields and reducing manufacturing cost accordingly.

DESCRIPTION OF THE PREFERRED EMBODIMENTS

Figure 1:
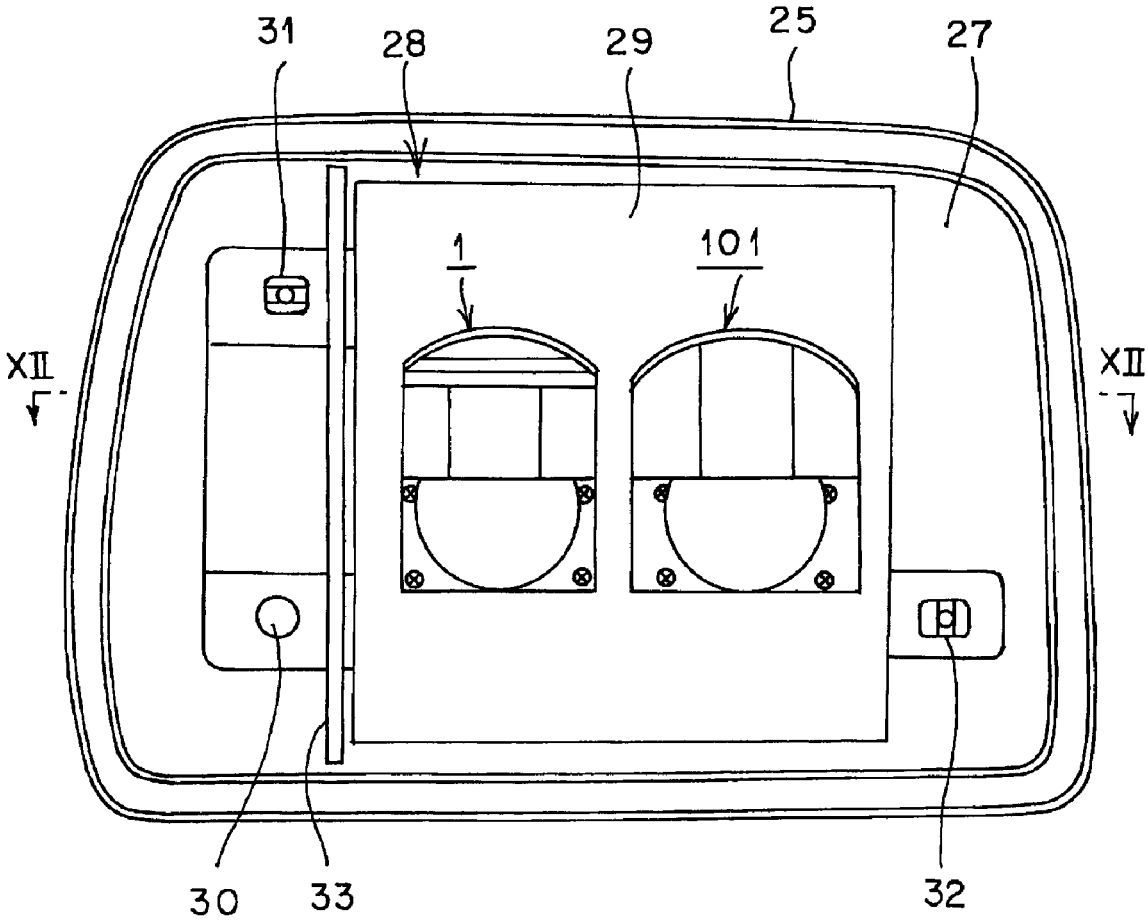
FIG. 1 is a front view showing an embodiment of a vehicle lighting device according to the invention in a state in which a lamp lens is not provided.

Hereinafter, an embodiment of a vehicle lighting device according to the present invention will be explained in detail, referring to the drawings. This embodiment does not limit the present invention. In the drawings, a symbol "F" denotes a vehicle front direction (vehicle forward-moving direction). A symbol "B" denotes a vehicle backward direction. A symbol "U" denotes an upward direction in which the front direction is seen from a driver's side. A symbol "D" denotes a downward direction in which the front direction is seen from the driver's side. A symbol "L" denotes a leftward direction in which the front direction is seen from the driver's side. A symbol "R" denotes a rightward direction in which the front direction is seen from the driver's side. A symbol "H-H" denotes a horizontal axis (an axis parallel to a vehicle forward-moving direction). The forward, backward, upward, downward, leftward, rightward, and horizontal directions are equivalent to those in a case where a vehicle is equipped with the vehicle lighting device according to the present invention. Further, a symbol "VU-VD" denotes a vertical line of the top and bottom of a screen. A symbol "HL-HR" denotes a horizontal line of the left and right of the screen.

Hereinafter, arrangement of a vehicle lighting device in the embodiment will be explained. The vehicle lighting device in the embodiment is a four-light system head lamp for passing (for low beam) of a reflector type (reflection type), for example, which is provided at each of the front left and right of a vehicle (automobile). The headlamp is used for left-hand traffic in Japan. A headlamp used for left-hand traffic in Europe has an arrangement which is substantially similar to that of the aforementioned headlamp. Further, headlamps used for right-hand traffic in Europe and for right-hand traffic in North America have an arrangement which is substantially similar to that of the aforementioned headlamps, and are reversely laid out at the left and right.

Hereinafter, an arrangement of the vehicle lighting device equipped at the front left side of a vehicle will be explained. The vehicle lighting device equipped at the front right side of the vehicle is made up of constituent elements which are substantially similar to those of the vehicle lighting device equipped at the front left side of the vehicle, and is made of a left and right-reversed layout. Thus, an explanation of the device is omitted here.

Figure 12:
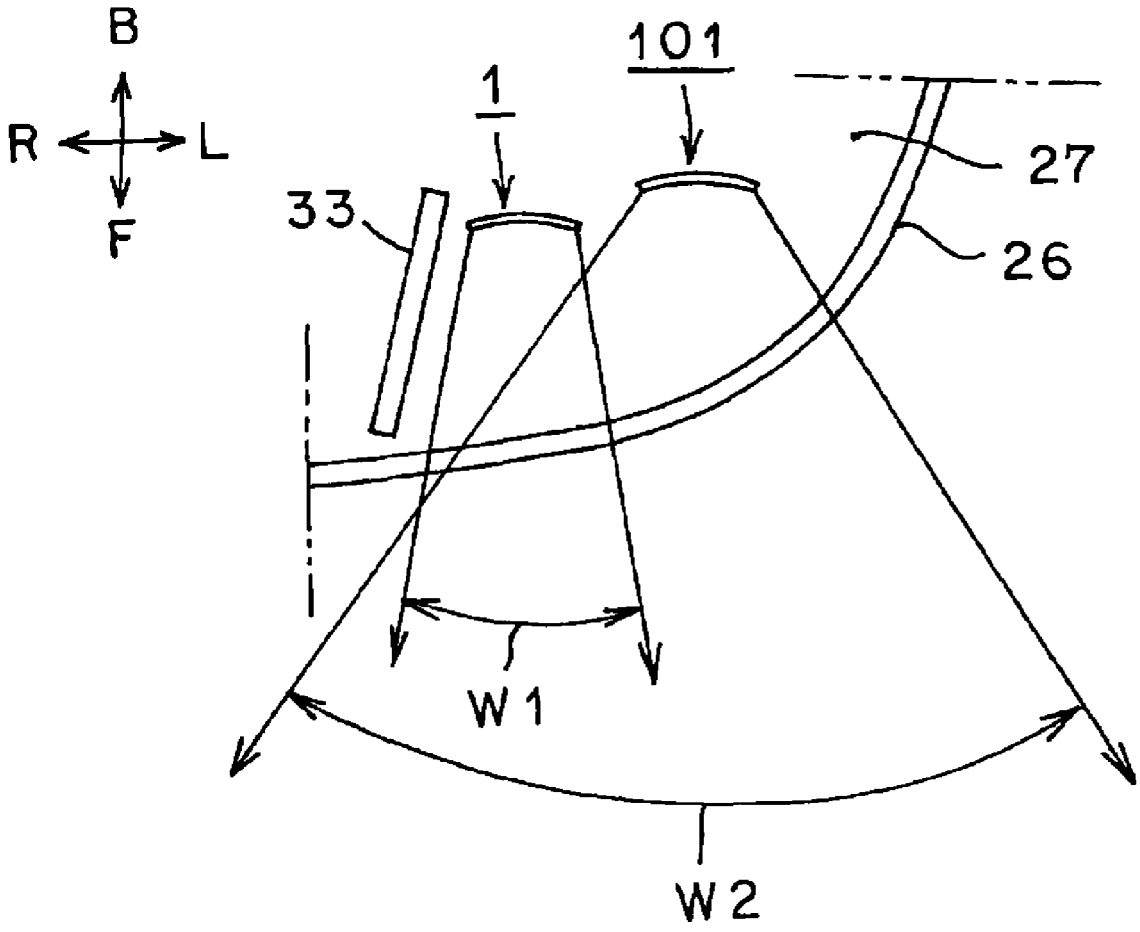
FIG. 12 is a schematic view for explaining a state in which the lamp unit for concentrating light is positioned inside of a vehicle relative to the lamp unit for diffusion.

The vehicle lighting device in the embodiment, as shown in FIGS. 1 and 12, is provided with: one lamp unit 1 for concentrating light; one lamp unit 101 for diffusion; a lamp housing 25; and a lamp lens 26 (such as a transparent outer lens, for example). The lamp unit 1 for concentrating light and the lamp unit 101 for diffusion are integrally disposed in a light room 27 partitioned by the lamp housing 25 and the lamp lens 26. The lamp unit 1 for concentrating light and the lamp unit 101 for diffusion are integrally mounted on the lamp housing 25 in an optical-axis adjustable manner via an optical-axis adjuster 28. Further, the lamp unit 1 for concentrating light is positioned inside (rightward) of the vehicle relative to the lamp unit 101 for diffusion.

The optical-axis adjuster 28, as shown in FIG. 1, is made up of: a bracket 29; a pivot mechanism 30; top and bottom adjust screws and a screw mounting 31; and left and right adjust screws and a screw mounting 32. The lamp units 1 and 101 for concentrating light and diffusion are integrally mounted on the bracket 29. The pivot mechanism 30, the top and bottom adjust screws and screw mounting 31, and the left and right adjust screws and screw mounting 32 are provided between the bracket 29 and the lamp housing 25. As a result, the lamp units 1 and 101 for concentrating light and diffusion are mounted on the lamp housing 25 in an optical-axis adjustable manner via the optical-axis adjuster 28.

Figure 10:
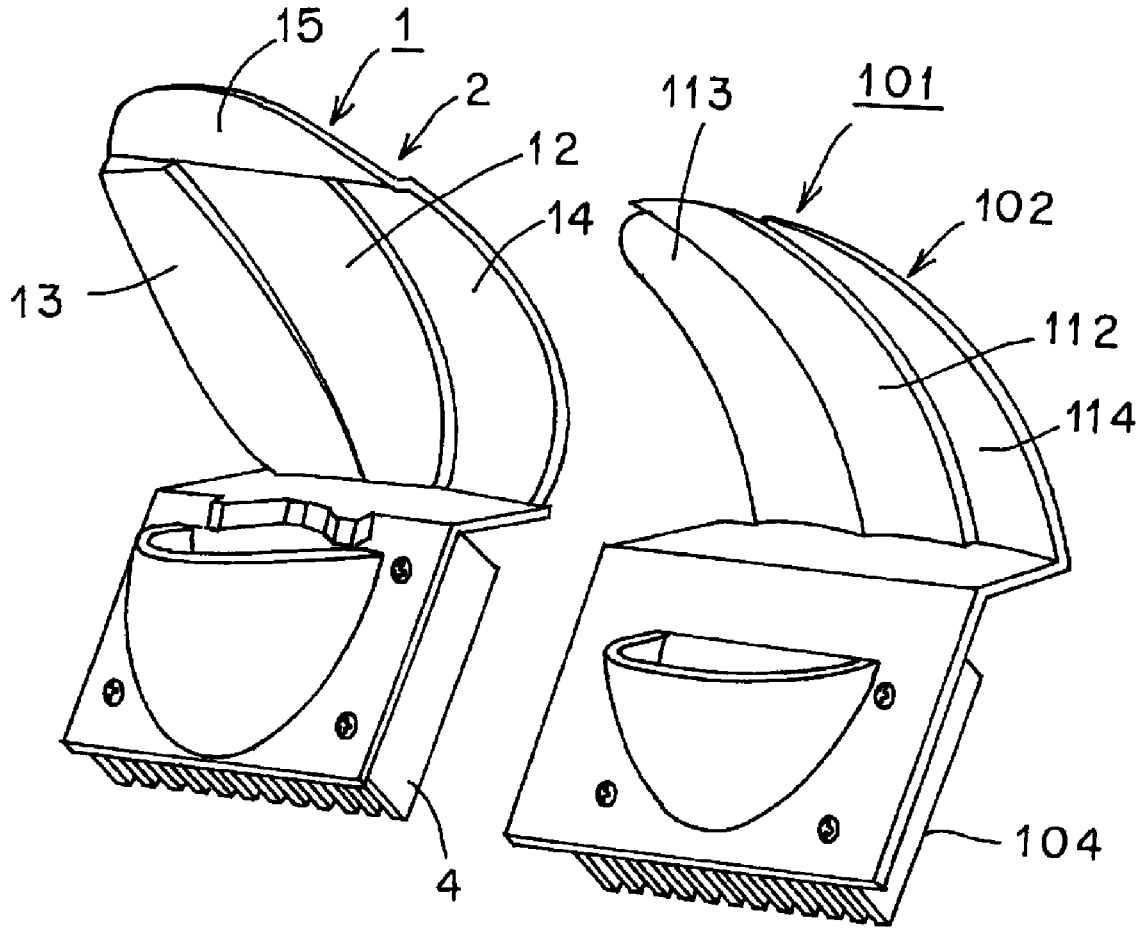
FIG. 10 is a perspective view showing the lamp unit for concentrating light and the lamp unit for diffusion.
Figure 11:
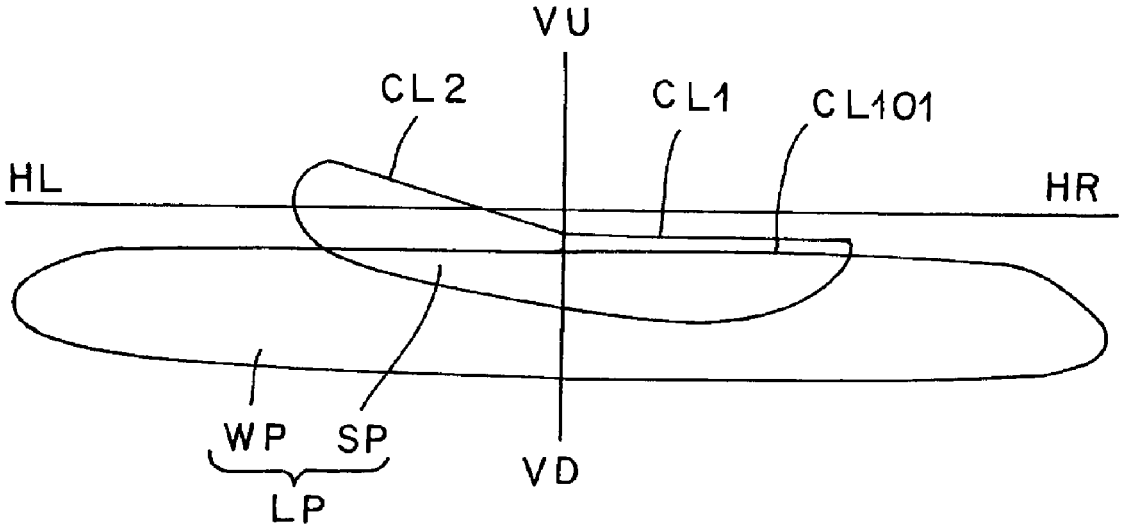
FIG. 11 is a schematic view for explaining light distribution patterns for passing, concentrating light, and diffusion, formed by the lamp units for concentrating light and diffusion.

As shown in FIGS. 1, 10, and 11, an inner panel 33 is disposed in the light room 27. The inner panel 33 is mounted on the lamp housing 25 or the bracket 29. The inner panel 33 is positioned inside (rightward) of the vehicle relative to the lamp units 1 and 101 for concentrating light and diffusion. The inner panel 33 covers the optical-axis adjuster 28 disposed in the light room 27 (the pivot mechanism 30 and the top and bottom adjust screws and screw mounting 31) or other parts (not shown) so as to be invisible when the inside of the light room 27 is seen from the lamp lens 26.

Figure 2:
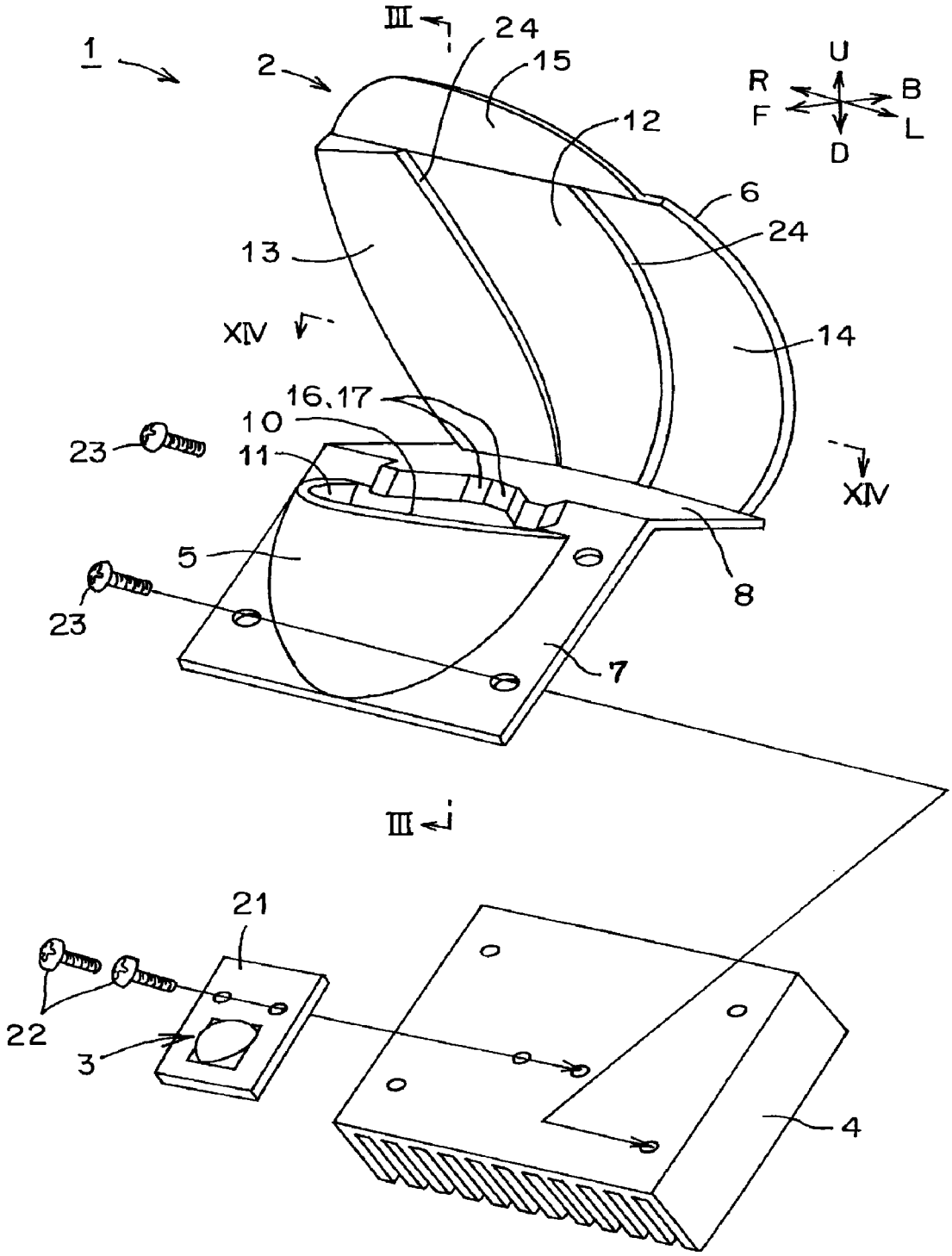
FIG. 2 is an exploded perspective view showing a reflector, a semiconductor-type light source, and a heat sink member, of a lamp unit for concentrating light.
Figure 3:
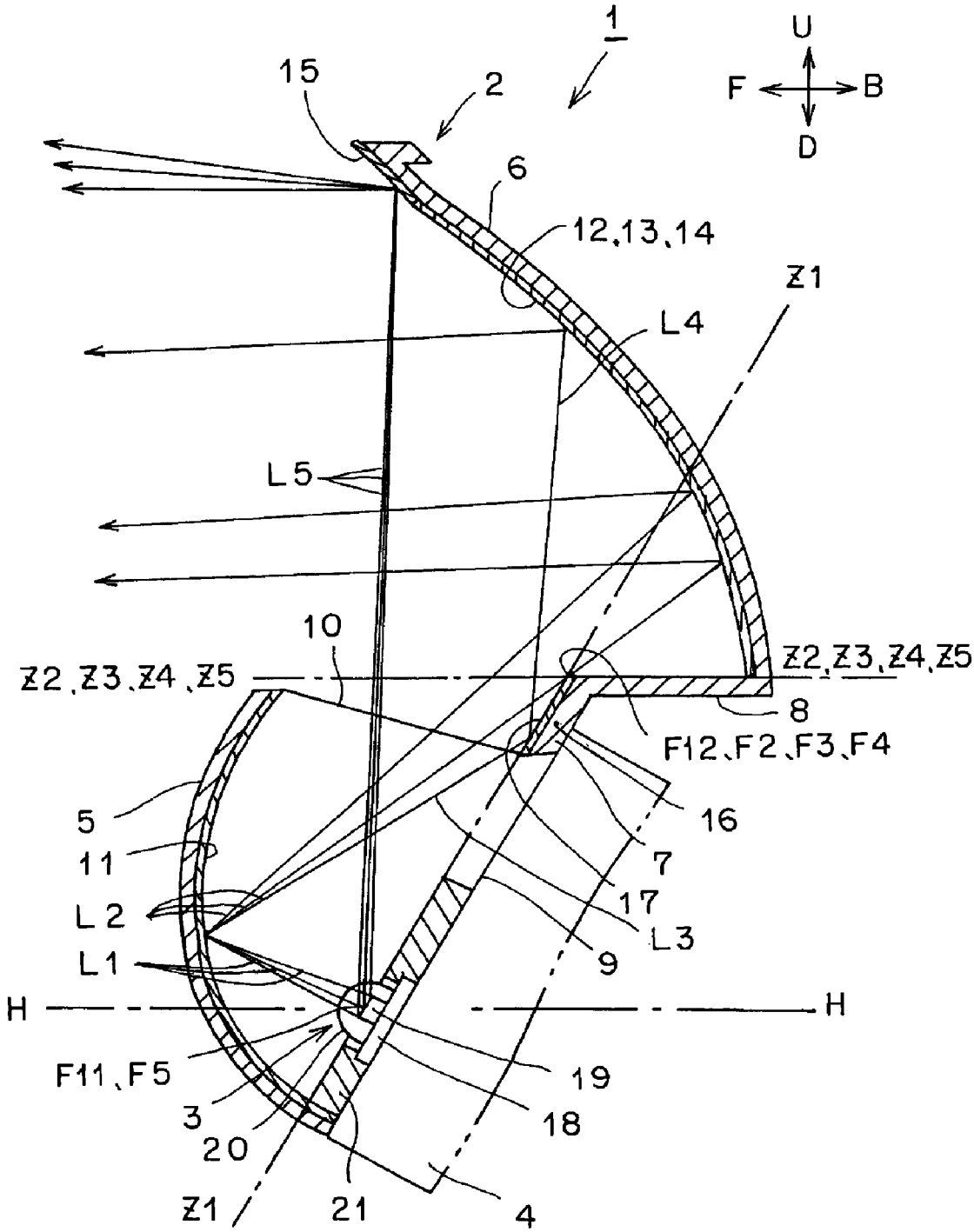
FIG. 3 is a longitudinal cross section (vertical cross section) corresponding to the cross section taken along the line III-III in FIG. 2 showing an optical path.

The lamp unit 1 for concentrating light, as shown in FIG. 2, is made up of a reflector 2, a semiconductor-type light source 3, and a heat sink member 4. The reflector 2 is made up of a material such as a light-reflecting resin, for example. The reflector 2, as shown in FIGS. 2 and 3, is integrally made up of an elliptical portion 5, a parabolic portion 6, an inclined portion 7, and a horizontal portion 8.

The elliptical portion 5 is formed in the shape of an ellipsoid of revolution which is divided into four sections in a long-axis direction and a short-axis direction, and has a first opening 9 in the long-axis direction and a second opening 10 in the short-axis direction. The inclined portion 7 is integrally provided at an edge of the first opening 9 of the elliptical portion 5. One edge (front edge) of the horizontal portion 8 is integrally provided at one edge (upper edge) of the inclined portion 7. One edge (lower edge) of the parabolic portion 6 is integrally provided at the other edge (rear edge) of the horizontal portion 8. The elliptical portion 5 is positioned at a frontally obliquely lower side relative to the parabolic portion 6. The parabolic portion 6 is opposite to the second opening 10 of the elliptical portion 5. The inclined portion 7, at one edge (upper edge), is inclined in an opposite direction (rear side) to a light radiating direction of the lamp unit 1 for concentrating light, and, at the other edge (lower edge), is inclined in the light radiating direction (front side) of the lamp unit 1 for concentrating light, relative to the horizontal portion 8. The horizontal portion 8 is (substantially) parallel to the horizontal axis H-H.

Optical parts such as first, second, third, fourth, and fifth reflecting surfaces 11, 12, 13, 14, and 15, a shade 16, and a shade reflecting surface 17 are integrally arranged on the reflector 2. In other words, aluminum evaporation or sliver painting is applied to an interior face opposite to the first opening 9 and the second opening of the elliptical portion 5, and the first reflecting surface 11 is integrally formed. Aluminum evaporation or silver painting is applied to an interior face opposite to the second opening 10 and the first reflecting surface 11 of the parabolic portion 6, and the second, third, fourth, and fifth reflecting surfaces 12, 13, 14, and 15 are integrally formed. The shade 16 is integrally formed at one edge (upper edge) of the inclined portion 7. Aluminum evaporation or silver painting is applied to a surface opposite to the second opening 10 of the shade 16 and the first, second, third, and fourth reflecting surfaces 11, 12, 13, and 14, and the shade reflecting surface 17 is integrally formed.

As the semiconductor-type light source 3, for example, a self-luminous semiconductor-type light source such as an LED or an electroluminescence (organic electroluminescence) (an LED in the embodiment) is used. The semiconductor-type light source 3, as shown in FIG. 3, is made of: a substrate 18; a light source chip 19 which is provided on one face of the substrate 18; and a hemispherical (dome-shaped) optically transparent member (lens) 20 covering the light source chip 19. The light source chip 19 is formed in a rectangular shape in this example.

The semiconductor-type light source 3 is fixed to the heat sink member 4 by means of a screw 22 via a holder 21. The inclined portion 7 of the reflector 2 is fixed to the heat sink member 4 by means of a screw 23. As a result, the lamp unit 1 for concentrating light is constituted. At this time, the first opening 9 of the elliptical portion 5 of the reflector 2 is closed by the heat sink member 4. The first reflecting surface 11 of the elliptical portion 5 of the reflector 2 is opposite to the semiconductor-type light source 3. Further, the light source chip 19 formed in a rectangular shape, of the semiconductor-type light source 3, is (substantially) orthogonal to the horizontal axis (vehicle forward-moving axis) H-H. In other words, the semiconductor-type light source 3 has an arrangement similar to that of a transverse differential bulb (a bulb of which columnar filament is (substantially) orthogonal to the horizontal axis (vehicle forward-moving axis) H-H). In FIG. 2, two screws 23 for fixing the reflector 2 to the heat sink member 4 are shown, whereas two screws are not shown.

The first reflecting surface 11 is an elliptical reflecting surface. The elliptical reflecting surface is a reflecting surface which is made up of a free curved surface with an ellipsoid being a key (base, reference) surface or is a reflecting surface which is made up of a surface having an ellipsoid of revolution. The reflecting surface made of a free curved surface with an ellipsoid being a key (base, reference) surface is a reflecting surface by which the vertical cross section of FIG. 3 forms an ellipsoid and a horizontal cross section (not shown) is made of a parabola, a deformed parabola or ellipsoid, or a combination thereof. As a result, the first reflecting surface 11 that is an elliptical reflecting surface has an optical axis Z1-Z1, a first focal point F11, and a second focal point (or second focal radiation) F12. As shown in FIG. 3, the optical axis Z1-Z1 of the first reflecting surface 11 is inclined relative to the horizontal axis H-H when viewed from a side face. The first focal point F11 is positioned at the frontally obliquely lower side relative to the second focal point F12. The light source chip 19 of the semiconductor-type light source 3 is positioned at or near the first focal point F11 of the first reflecting surface 11. As a result, a majority L1 of light radiated from the light source chip 19 of the semiconductor-type light source 3 is reflected by the first reflecting surface 11, and converges (gathers) at or near the second focal point F12 of the first reflecting surface 11.

The second, third, fourth, and fifth reflecting surfaces 12, 13, 14, and 15 are parabolic reflecting surfaces. The parabolic reflecting surfaces are reflecting surfaces which are made up of free curved surfaces with a parabola being a key (base, reference) surface or reflecting surfaces which are made of surfaces having a parabola of revolution. The reflecting surfaces made of free curved surfaces with a parabola being a key (base, reference) surface are reflecting surfaces by which the vertical cross section of FIG. 3 forms a parabola and a horizontal cross section (not shown) is made of an ellipsoid, a deformed ellipsoid, a deformed parabola or a combination thereof. As a result, the second, third, fourth, and fifth reflecting surfaces 12, 13, 14, and 15 that are parabolic reflecting surfaces have optical axes Z2-Z2, Z3-Z3, Z4-Z4, Z5-Z5, and focal points (focal radiations) F2, F3, F4, F5. As shown in FIG. 3, the optical axes Z2-Z2, Z3-Z3, Z4-Z4, Z5-Z5 of the second, third, fourth, and fifth reflecting surfaces 12, 13, 14, and 15 are (substantially) parallel to the horizontal axis H-H when viewed from the side face. The focal points F2, F3, F4 of the second, third, and fourth reflecting surfaces 12, 13, and 14 are positioned at or near the second focal point F12 of the first reflecting surface 11. A focal point F5 of the fifth reflecting surface 15 is positioned at or near the first focal point F11 of the first reflecting surface 11.

The first reflecting surface 11 is positioned at the frontally obliquely lower side relative to the second, third, fourth, and fifth reflecting surfaces 12, 13, 14, and 15. An opening for passing reflected light from the first reflecting surface 11 and direct light from the semiconductor-type light source 3 to the second, third, fourth, and fifth reflecting surfaces 12, 13, 14, and 15, i.e., the second opening 10 is provided between a side on which the first reflecting surface 11 and the semiconductor light source 3 are present and a site on which the second, third, fourth, and fifth reflecting surfaces 12, 13, 14, and 15 are present.

The shade 16 cuts off part L3 of reflected light L2 from the first reflecting surface 11. An edge of the shade 16, i.e., a corner between the inclined portion 7 and the horizontal portion 8 is involved in forming a cutoff line of a light distribution pattern. On the other hand, the shade reflecting surface 17 reflects the part L3 of the reflected light L2 from the first reflecting surface 11, the part being cut off by the shade 16, on the second, third, and fourth reflecting surfaces 12, 13, and 14.

The second, third, and fourth reflecting surfaces 12, 13, and 14 as parabolic reflecting surfaces are longitudinally divided as shown in FIG. 2. The second reflecting surface 12 is positioned between the third and fourth ones. The third reflecting surface 13 is positioned at the right side of the second reflecting surface 12. The fourth reflecting surface 14 is positioned at the left side of the second reflecting surface 12. Although not shown in the figure, the third reflecting surface 13 at the opposite lane side (right side) is positioned at the light reflecting direction (front side) relative to the second reflecting surface 12 of the driving lane (left side). The second reflecting surface 12 of the opposite lane side (right side) is positioned at the light reflecting direction (front side) relative to the fourth reflecting surface 14 of the driving lane side (left side). As a result, longitudinal steps 24 among the longitudinally divided second, third, and fourth reflecting surfaces 12, 13, and 14 are oriented to the driving lane side (left side).

Figure 7:
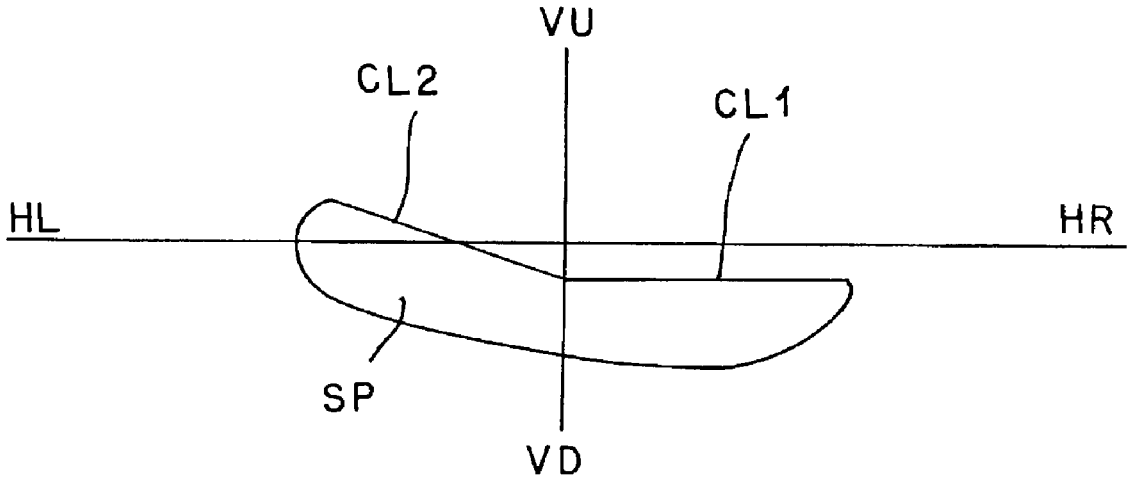
FIG. 7 is a schematic diagram for explaining a light distribution pattern for concentrating light, of a light distribution pattern for passing formed by the lamp unit for concentrating light.
Figure 8:
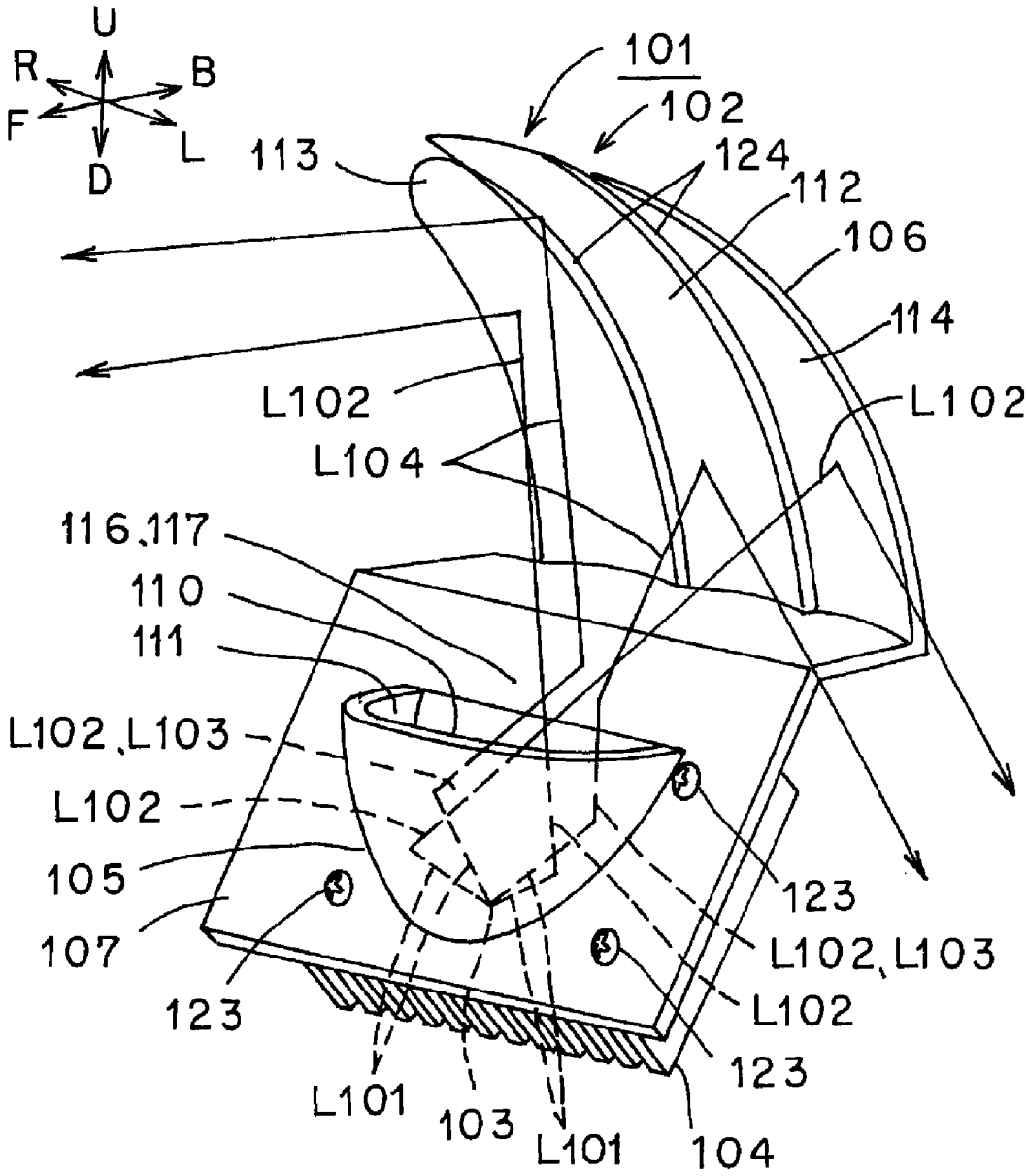
FIG. 8 is a schematic diagram for explaining an effect of the lamp unit for diffusion.

The second, third, and fourth reflecting surfaces 12, 13, and 14 are reflecting surfaces for controlling reflected light L2 from the first reflecting surface 11 (reflected light L2 from the first reflecting surface 11 that has not been cut off by the shade 16) and reflected light L4 from the shade reflecting surface 17 (part L3 of the reflected light L2 from the first reflecting surface 11 that has been cut off by the shade 16) and reflecting the controlled reflected light on a road surface, as a light distribution pattern SP for concentrating light shown in FIG. 7. A horizontal cutoff line CL1 and an oblique cutoff line CL2 are formed at an upper edge of the light distribution pattern SP for concentrating light. The horizontal cutoff line CL1 and the oblique cutoff line CL2, of the light distribution pattern SP for concentrating light, are formed by an edge of the shade 16 and the second, third, and fourth reflecting surfaces 12, 13, and 14. The horizontal cutoff line CL1 of the light distribution pattern SP for concentrating light is positioned by about 0.57 degree lower than the horizontal left-right line HL-HR of a screen. Further, the oblique cutoff line CL2 of the light distribution pattern SP for concentrating light is inclined by about 15 to 45 degrees leftward from the vertical up-down line VU-VD of a screen of the horizontal cutoff line CL1. The light distribution pattern SP for concentrating light is a hot spot of the light distribution pattern LP for passing shown in FIG. 11, and satisfies a main light distribution standard for the light distribution pattern LP for passing. A high luminous intensity (hot spot) having the highest luminous intensity exists in the light distribution pattern SP for concentrating light.

The fifth reflecting surface 15, as shown in FIG. 2, is positioned upwardly of the second, third, and fourth reflecting surfaces 12, 13, and 14 that are longitudinally divided. The fifth reflecting surface 15 is a reflecting surface by which light (direct light) L5 from the semiconductor-type light source 3 is controlled, and the controlled light is reflected as a light distribution pattern OP for overhead sign shown in FIG. 15. The light distribution pattern OP for overhead sign is positioned upper than the horizontal left and right lines HL-HR of a screen, and illuminates an overhead sign (not shown).

The parabolic reflecting surfaces are divided into four segments, i.e., the second, third, fourth, and fifth reflecting surfaces 12, 13, 14, and 15. Further, the second, third, fourth, and fifth reflecting surfaces 12, 13, 14, and 15 are made of single or plural segments according to light distribution characteristics, respectively.

Figure 4:
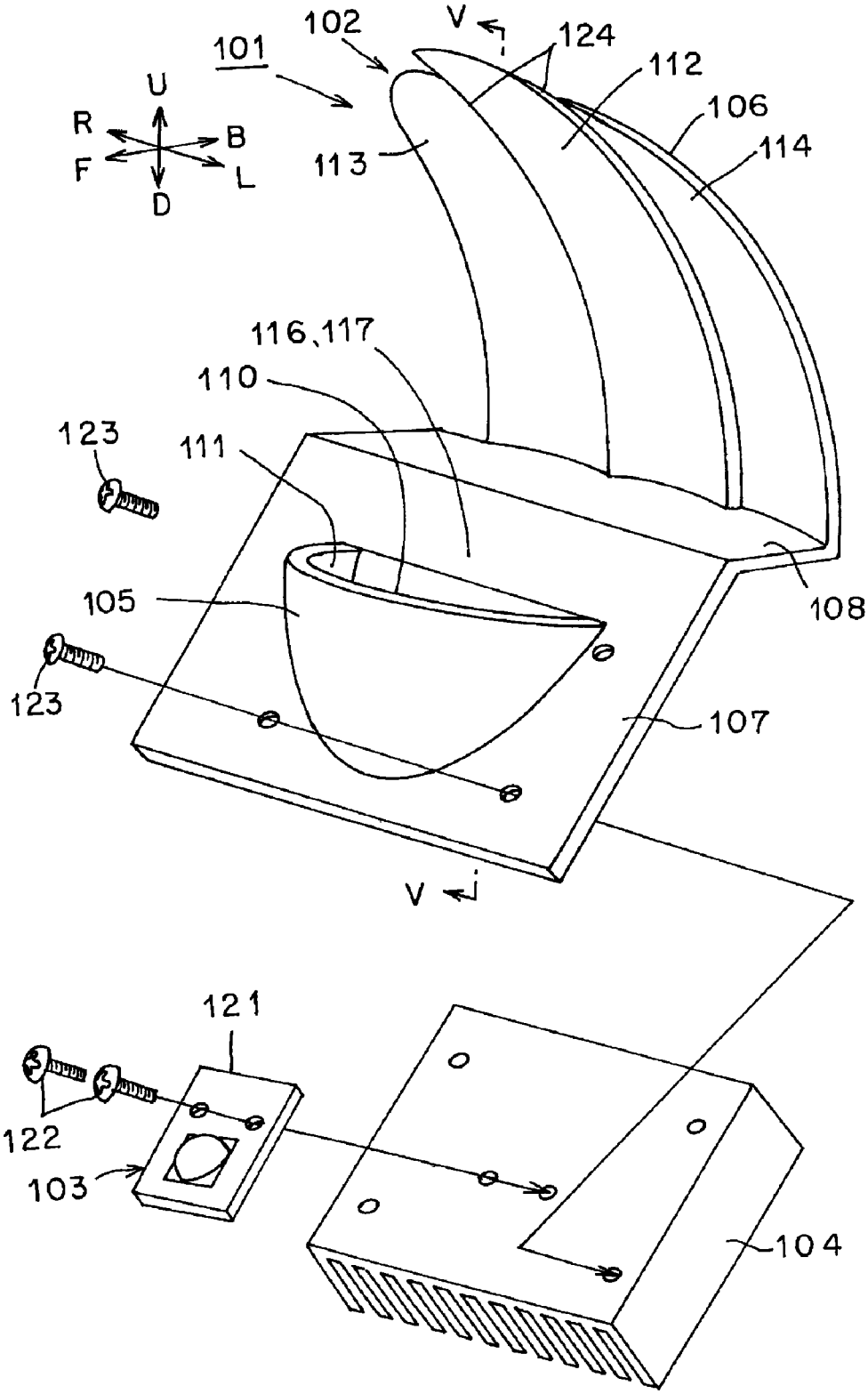
FIG. 4 is an exploded perspective view showing a reflector, a semiconductor-type light source, and a heat sink member of a lamp unit for diffusion.
Figure 5:
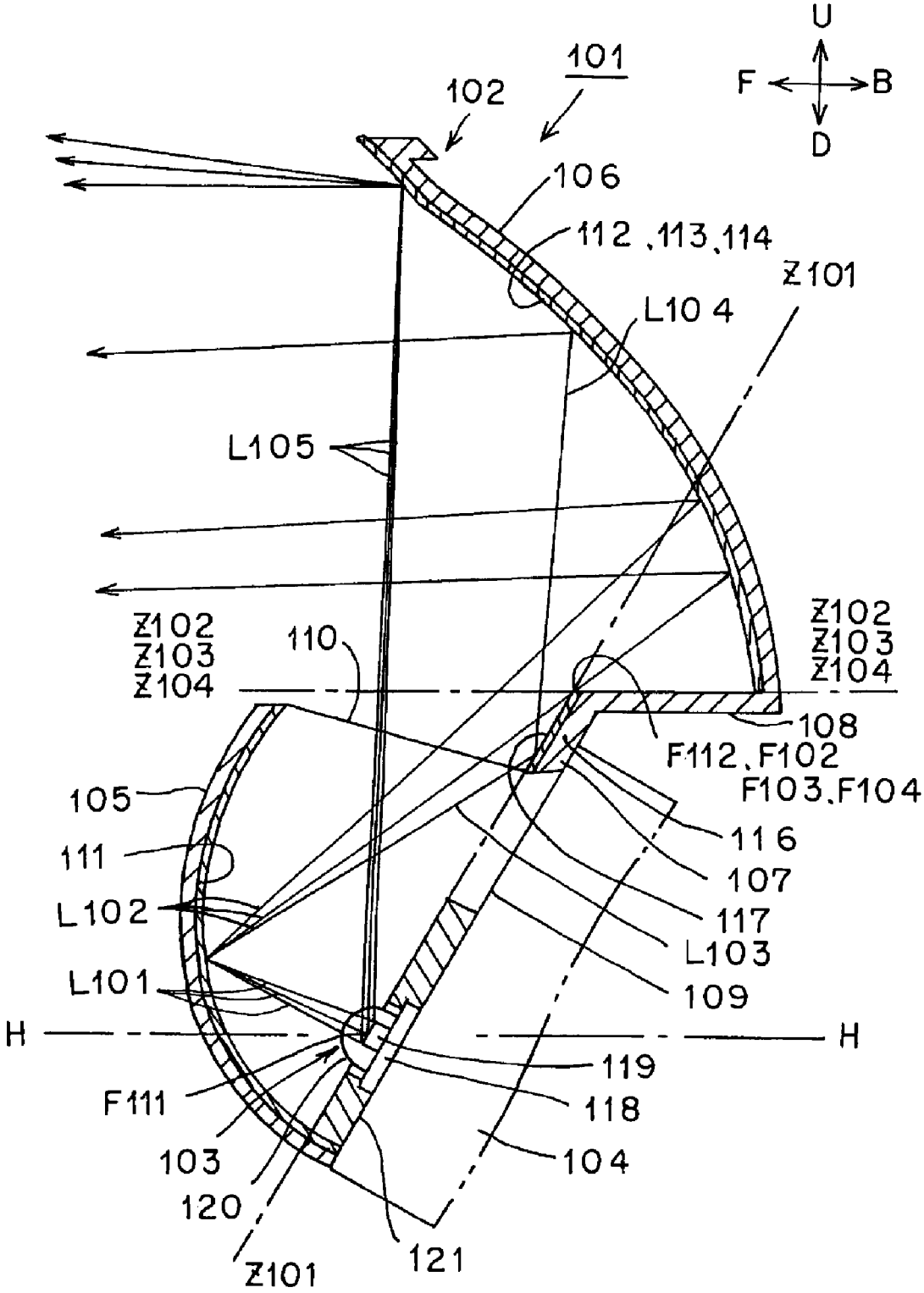
FIG. 5 is a longitudinal cross section (vertical cross section) corresponding to the cross section taken along the line V-V in FIG. 4 showing an optical path.
Figure 6:
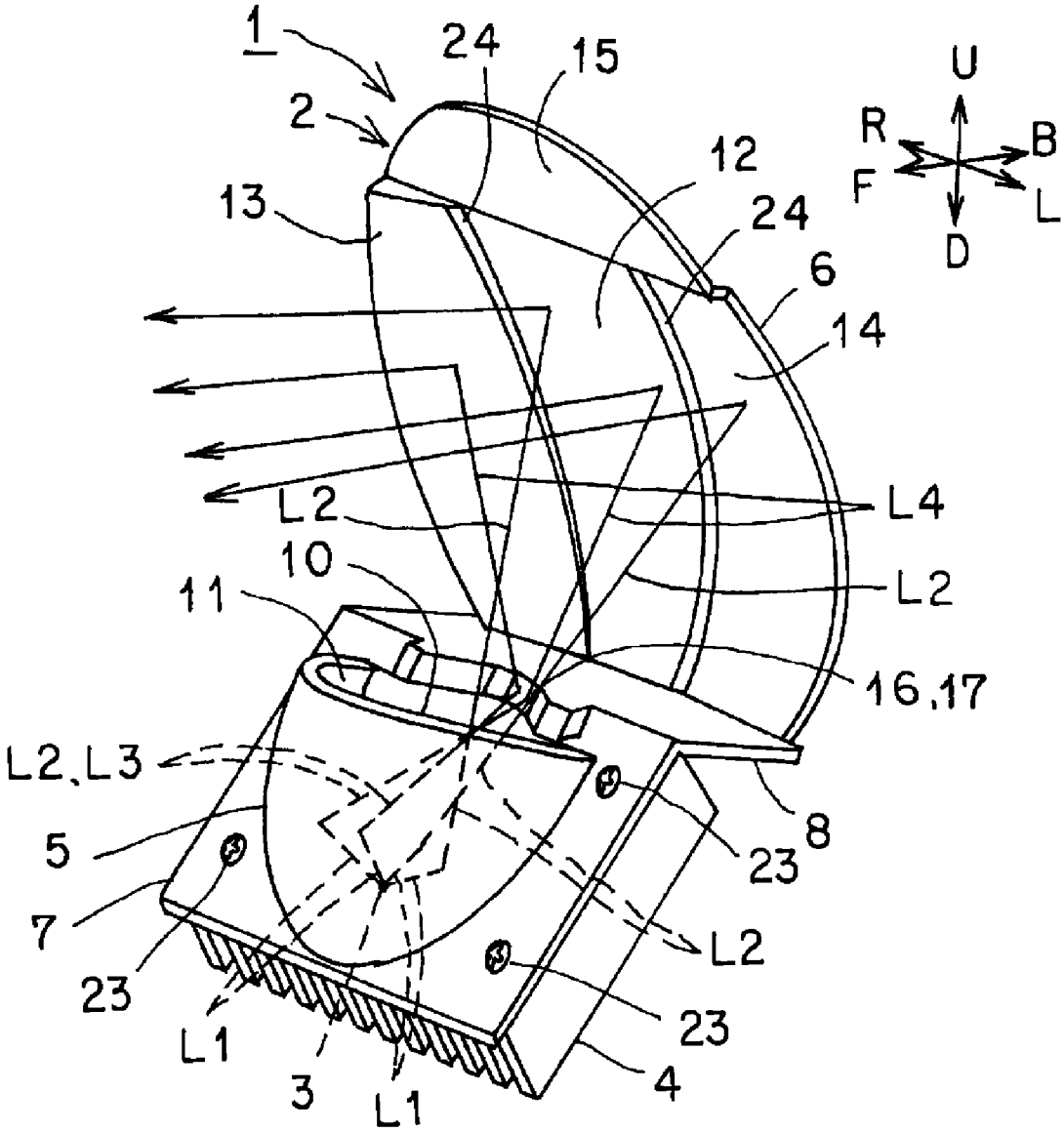
FIG. 6 is a schematic diagram for explaining an effect of the lamp unit for concentrating light.

Like the lamp unit 1 for concentrating light, the lamp unit 101 for diffusion is made up of a reflector 102, a semiconductor-type light source 103, and a heat sink member 104, as shown in FIG. 4. The reflector 102 is made up of a light-reflecting resin, for example. The reflector 102, as shown in FIGS. 4 and 5, is integrally made up of an elliptical portion 105, a parabolic portion 106, an inclined portion 107, and a horizontal portion 108.

The elliptical portion 105 is formed such that an elliptical shape of revolution is divided into four sections in the long-axis and short-axis directions, and has a first opening 109 in the long-axis direction and a second opening 110 in the short-axis direction. The inclined portion 107 is integrally provided at an edge of the first opening 109 of the elliptical portion 105. One edge (front edge) of the horizontal portion 108 is integrally provided at one edge (upper edge) of the inclined portion 107. One edge (lower edge) of the parabolic portion 106 is integrally provided at the other edge (rear edge) of the horizontal portion 108. The elliptical portion 105 is positioned at the frontally oblique lower side relative to the parabolic portion 106. The parabolic portion 106 is opposite to the second opening 110 of the elliptical portion 105. The inclined portion 107, at one edge (upper edge), is inclined in the opposite direction (rear side) to the light radiating direction of the lamp unit 101 for diffusion, and, at the other end (lower edge), is inclined in the light radiating direction (front side) of the lamp unit 101 for diffusion, relative to the horizontal portion 108. The horizontal portion 108 is (substantially) parallel to the horizontal axis H-H.

Optical parts such as the first, second, third, and fourth reflecting surfaces 111, 112, 113, and 114, the shade 116, and the shade reflecting surface 117 are integrally formed on the reflector 102. In other words, aluminum evaporation or sliver painting is applied to the internal face opposite to the first and second openings 109 and 110 of the elliptical portion 105, and the first reflecting surface 11 is integrally formed. Aluminum evaporation or silver painting is applied to the internal face opposite to the second opening 110 of the parabolic portion 106 and the first reflecting surface 111, and the second, third, and fourth reflecting surfaces 112, 113, and 114 are integrally formed. The shade 116 is integrally formed at one edge (upper edge) 7 of the inclined portion 107. Aluminum evaporation or silver painting is applied to the face opposite to the second opening 110 of the shade 116, and the first, second, third, and fourth reflecting surfaces 111, 112, 113, and 114, and the shade reflecting surface 117 is integrally formed.

The semiconductor-type light source 103 uses a self-luminous semiconductor-type light source such as an LED or an EL (an organic EL) (an LED in the embodiment). The semiconductor-type light source 103, as shown in FIG. 5, is made up of: a substrate 118; a light source chip 119 provided on one face of the substrate 118; and a light-reflecting member (lens) 120 formed in the hemispheric shape (dome-shape) covering the light source chip 119. The light source chip 119 is formed in the rectangular shape in this example.

The semiconductor-type light source 103 is fixed to the heat sink member 104 by means of a screw 122 via a holder 121. Further, the inclined portion 107 of the reflector 102 is fixed to the heat sink member 104 by means of a screw 123. As a result, the lamp unit 101 for diffusion is formed. At this time, the first opening 109 of the elliptical portion 105 of the reflector 102 is closed by the heat sink member 104. The first reflecting surface 111 of the elliptical portion 105 of the reflector 102 is opposite to the semiconductor-type light source 103. Further, the rectangular light source chip 119 of the semiconductor-type light source 103 is (substantially) orthogonal to the horizontal axis (vehicle forward-moving axis). In other words, the semiconductor-type light source 103 has an arrangement similar to that of a transverse differential bulb (a bulb of which a columnar filament is (substantially) orthogonal to the horizontal axis (vehicle forward-moving axis) H-H. In FIG. 4, two screws 123 for fixing the reflector 102 to the heat sink member 104 are shown, whereas two screws are not shown.

The first reflecting surface 111 is an elliptical reflecting surface. The elliptical reflecting surface is a reflecting surface made of a free curved surface with an ellipsoid being a key (base, reference) or is a reflecting surface made of a surface having an ellipsoid of revolution. The reflecting surface made of a free curved surface with an ellipsoid being a key (base, reference) is a reflecting surface of which the vertical cross section of FIG. 5 is elliptical and the horizontal cross section (not shown) is made of a parabola, a deformed parabola, a deformed ellipsoid, or a combination thereof. As a result, the first reflecting surface 111 that is an elliptical reflecting surface has an optical axis Z101-Z101, a first focal point F111, and a second focal point (or a second focal radiation) F112. As shown in FIG. 5, the optical axis Z101-Z101 of the first reflecting surface 111 is inclined relative to the horizontal axis H-H when viewed from a side face. The first focal point 111 is positioned at the frontally obliquely lower side relative to the second focal point F112. The light source chip 119 of the semiconductor-type light source 103 is positioned at or near the first focal point F111 of the first reflecting surface 111. As a result, a majority L101 of the light radiated from the light source chip 119 of the semiconductor-type light source 103 is reflected by the first reflecting surface 111, and converges (gathers) at or near the second focal point F112 of the first reflecting surface 111.

The second, third, and fourth reflecting surfaces 112, 113, and 114 are parabolic reflecting surfaces. The parabolic reflecting surfaces are reflecting surfaces which are made up of free curved surfaces with a parabola being a key (base, reference) surface or reflecting surfaces which are made of surfaces having a parabola of revolution. The reflecting surfaces made of free curved surfaces with a parabola being a key (base, reference) surface are reflecting surfaces by which the vertical cross section of FIG. 5 forms a parabola and a horizontal cross section (not shown) is made of an ellipsoid, a deformed ellipsoid, a deformed parabola, or a combination thereof. As a result, the second, third, and fourth reflecting surfaces 112, 113, and 114 that are parabolic reflecting surfaces have optical axes Z102-Z102, Z103-Z103, Z104-Z104 and optical focal points (focal radiations) F102, F103, F104. As shown in FIG. 5, the optical axes Z102-Z102, Z103-Z103, Z104-Z104 of the second, third, and fourth reflecting surfaces 112, 113, and 114 are (substantially) parallel to the horizontal axis H-H when viewed from a side face. The focal points F102, F103, F104 of the second, third, and fourth reflecting surfaces 112, 113, and 114 are positioned at or near the second focal point F112 of the first reflecting surface 111.

The first reflecting surface 111 is positioned at the frontally obliquely lower side relative to the second, third, and fourth reflecting surfaces 112, 113, and 114. An opening for routing reflected light from the first reflecting surface 111 and direct light from the semiconductor-type light source 103 onto the second, third, and fourth reflecting surfaces 112, 113, and 114, i.e., the second opening 110 is provided between a side on which the first reflecting surface 111 and the semiconductor-type light source 103 are present and a side on which the second, third, and fourth reflecting surfaces 112, 113, and 114 are present.

The shade 116 cuts off part L103 of the reflected light L102 from the first reflecting surface 111. An edge of the shade 116, i.e., a corner between the inclined portion 107 and the horizontal portion 108 is involved in forming the cutoff line of a light distribution pattern. On the other hand, the shade reflecting surface 117 reflects the part L103 of the reflected light L102 from the first reflecting surface 111 cut off by the shade 116 on the second, third, and fourth reflecting surfaces 112, 113, and 114.

The second, third, and fourth reflecting surfaces 112, 113, and 114, all of which are parabolic reflecting surfaces, are longitudinally divided as shown in FIG. 4. The second reflecting surface 112 is positioned in the middle. The third reflecting surface 113 is positioned at the right side of the second reflecting surface 112. The fourth reflecting surface 114 is positioned at the left side of the second reflecting surface 112. Although not shown in the figure, the third reflecting surface 113 at the opposite lane side (right side) is positioned at the light reflecting direction (front side) relative to the second reflecting surface 112 at the driving lane side (left side). The second reflecting surface 112 at the opposite lane side (right side) is positioned at the light reflecting direction (front side) relative to the fourth reflecting surface 114 at the driving lane side (left side). As a result, longitudinal steps 124 between the second, third, and fourth reflecting surfaces 112, 113, and 114 that are longitudinally divided are oriented to the driving lane side (left side).

Figure 9:
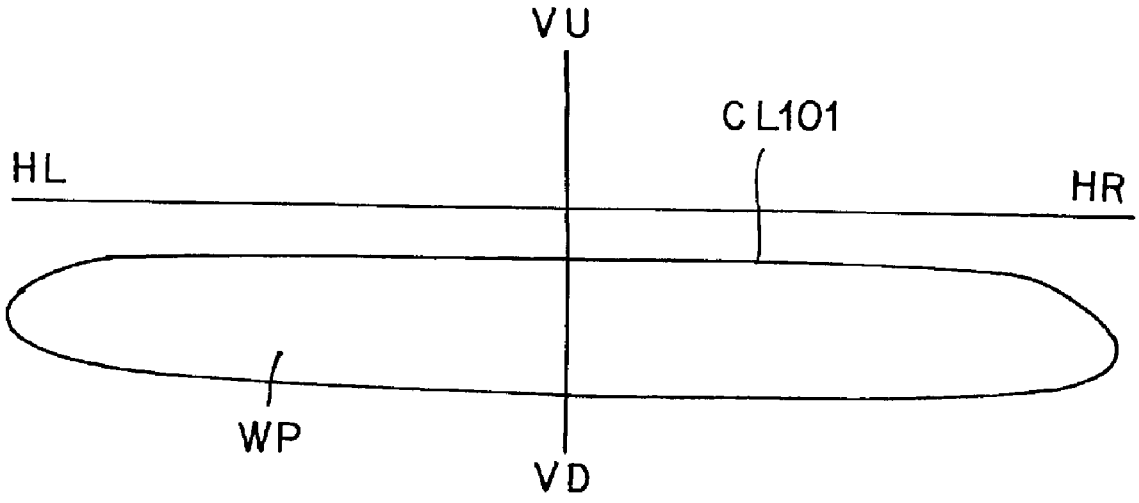
FIG. 9 is a schematic diagram for explaining a light distribution pattern for diffusion, of a light distribution pattern for passing formed by the lamp unit for diffusion.
Figure 15:
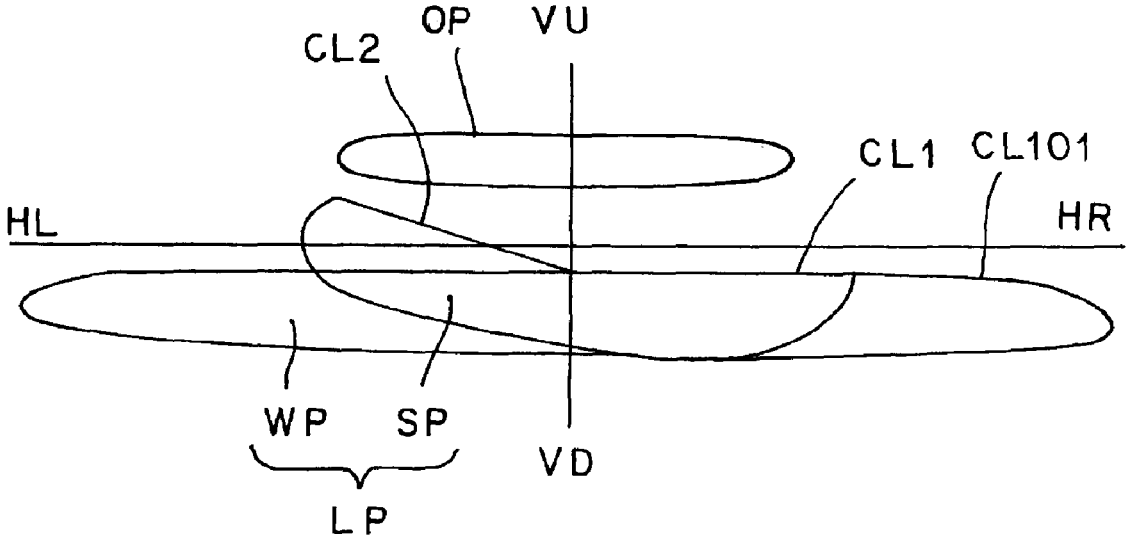
FIG. 15 is a schematic view for explaining the light distribution patterns for passing, concentrating light, diffusion, and overhead sign, formed by the lamp units for concentrating light and diffusion.

The second, third, and fourth reflecting surfaces 112, 113, and 114 are reflecting surfaces for controlling the reflected light L102 from the first reflecting surface 111 (reflected light L102 from the first reflecting surface 111, which has not been cut off by the shade 116), the reflected light L104 from the shade reflecting surface 117 (part L103 of the reflected light L102 from the first reflecting surface 111, which has been cut off by the shade 116), and the light (direct light) L105 from the semiconductor-type light source 103, and reflecting the controlled light on a road surface, as a light distribution pattern WP for diffusion shown in FIG. 9. A horizontal cutoff line CL101 is formed at the upper edge of the light distribution pattern WP for diffusion. The horizontal cutoff line CL101 of the light distribution pattern WP for diffusion is formed by an edge of the shade 116 and the second, third, and fourth reflecting surfaces 112, 113, and 114. The light distribution pattern WP for diffusion is horizontal diffusion of a light distribution pattern LP for passing shown in FIG. 11, and forms diffused light distribution which improves marketability of the light distribution pattern LP for passing. The horizontal cutoff line CL101 of the light distribution pattern WP for diffusion is set by about 0.3 to 1 degree lower than the horizontal cutoff line CL1 of the light distribution pattern SP for concentrating light. As shown in FIG. 15, the horizontal cutoff line CL101 of the light distribution pattern WP for diffusion may be set at the same position as that of the horizontal cutoff line CL1 of the light distribution pattern SP for concentrating light.

The parabolic reflecting surfaces are divided into three segments, the second, third, and third reflecting surfaces 112, 113, and 114. The second, third, and fourth reflecting surfaces 112, 113, and 114 are made of single or plural segments, according to light distribution characteristics, respectively. In the lamp unit 101 for diffusion, like the lamp unit 1 for light concentration, a fifth reflecting surface for overhead sign, which is a parabolic reflecting surface, may be provided upwardly of the second, third, and fourth reflecting surfaces 112, 113, and 114.

The vehicle lighting device in the embodiment is made up of the constituent elements set forth above. Hereinafter, effects of the device will be described.

The light source chip 19 of the semiconductor-type light source 3 of the lamp unit 1 for concentrating light and the light source chip 119 of the semiconductor-type light source 103 of the lamp unit 101 for diffusion are intended to illuminate and emit light. After that, in the lamp unit 1 for concentrating light, the majority L1 of the light radiated from the light source chip 19 of the semiconductor-type light source 3 is incident to the first reflecting surface 11. Further, part L5 of the light radiated from the light source chip 19 of the semiconductor-type light source 3, as direct light, is mainly directly incident to the fifth reflecting surface 15 through the second opening 10 of the reflector 2.

The light L1 incident to the first reflecting surface 11 is reflected by the first reflecting surface 11. The reflected light L2 reflected by the first reflecting surface 11 is prone to converge (gather) at or near the second focal point F12 of the first reflecting surface 11. The reflected light L2 from the first reflecting surface 11, the reflected light having not been cut off by the shade 16, is mainly incident to the second, third, and fourth reflecting surfaces 12, 13, and 14 through the second opening 10 of the reflector 2. Further, the part L3 of the reflected light L2 from the first reflecting surface 11, the reflected light having been cut off by the shade 16, is reflected by the shade reflecting surface 17. The reflected light L4 from the shade reflecting surface 17 is mainly incident to the second, third, and fourth reflecting surfaces 12, 13, and 14 through the second opening 10 of the reflector 2.

The rays of the reflected light L2 from the first reflecting surface 11 and the reflected light L4 from the shade reflecting surface 17, both of which are incident to the second, third, and fourth reflecting surfaces 12, 13, and 14, are reflected by the second, third, and fourth reflecting surfaces 12, 13, and 14. The rays of the reflected light from the second, third, and fourth reflecting surfaces 12, 13, and 14 are controlled on the second, third, and fourth reflecting surfaces 12, 13, and 14, as a light distribution pattern SP for concentrating light shown in FIG. 7, i.e., as a light distribution pattern SP for concentrating light having a horizontal cutoff line CL1 and an oblique cutoff line CL2 on an upper edge, and a road surface is radiated with the rays of the controlled reflected light.

The direct light L5 from the light source chip 19 of the semiconductor-type light source 3, directly incident to the fifth reflecting surface 15, is reflected by the fifth reflecting surface 15. The reflected light from the fifth reflecting surface 15 is controlled on the fifth reflecting surface 15, as a light distribution pattern OP for overhead sign shown in FIG. 15, and the overhead sign is radiated with the controlled reflected light.

On the other hand, in the lamp unit 101 for diffusion, the majority L101 of the light radiated from the light source chip 119 of the semiconductor-type light source 103 is incident to the first reflecting surface 111. The majority L101 of the light incident to the first reflecting surface 111 is reflected by the first reflecting surface 111. The reflected light L102 reflected by the first reflecting surface 111 is prone to converge (gather) at or near the second focal point F112 of the first reflecting surface 111. The reflected light L102 from the first reflecting surface 111, the reflected light having not cut off by the shade 116, is mainly incident to the second, third, and fourth reflecting surfaces 112, 113, and 114 through the second opening 110 of the reflector 102. Further, the part L103 of the reflected light L102 from the first reflecting surface 111, the reflected light having been cut off by the shade 116, is reflected by the shade reflecting surface 117. The reflected light L104 from the shade reflecting surface 117 is mainly incident to the second, third, and fourth reflecting surfaces 112, 113, and 114 through the second opening 110 of the reflector 102.

The reflected light L102 from the first reflecting surface 111 and the reflected light L104 from the shade reflecting surface 117, both of which are incident to the third and fourth reflecting surfaces 112, 113, and 114, are reflected by the second, third, and fourth reflecting surfaces 112, 113, and 114. The rays of the reflected light from the second, third, and fourth reflecting surfaces 112, 113, and 114 are controlled on the second, third, and fourth reflecting surfaces 112, 113, and 114, as a light distribution pattern WP for diffusion shown in FIG. 9, i.e., as a light distribution pattern WP for diffusion having a horizontal cutoff line CL101 on an upper edge, and a road surface is radiated with the controlled reflected light.

The light distribution pattern SP for concentrating light shown in FIG. 7 and the light distribution pattern WP for diffusion shown in FIG. 9 are superimposed on each other, forming the light distribution pattern LP for passing shown in FIG. 11 or FIG. 15, i.e., a light distribution pattern LP for passing having the horizontal cutoff lines CL1, CL101 and the oblique cutoff line CL2 on an upper edge. Further, as shown in FIG. 15, a light distribution pattern OP for overhead sign is obtained by the fifth reflecting surface 15 of the lamp unit 1 for concentrating light.

If the luminous flux (luminous intensity, illumination, light quantity) of a respective one of the semiconductor-type light sources 3, 103 is large, a light distribution pattern LP for passing (light distribution pattern SP for concentrating light and light distribution pattern WP for diffusion) having predetermined light distribution characteristics and a light distribution pattern OP for overhead sign, are obtained by the respective one of the lamp unit 1 for concentrating light and the lamp unit 103 for diffusion.

The vehicle lighting device in the embodiment is made of the constituent elements and effects as described above. Hereinafter, advantageous effects of the device will be described.

The vehicle lighting device in the embodiment (lamp unit 1 for concentrating light and lamp unit 101 for diffusion) satisfies main light distribution standards by means of the lamp unit 1 for concentrating light; forms a light distribution pattern SP for concentrating light as a standard for an optical axis; and forms a light distribution pattern WP for diffusion which improves marketability by means of the lamp unit 101 for diffusion. As a result, in the vehicle lighting device in the embodiment (lamp unit 1 for concentrating light and lamp unit 101 for diffusion), one lamp unit 1 for concentrating light is provided which satisfies the main light distribution standard and forms a light distribution pattern for concentrating light as a standard for an optical axis, thereby facilitating adjustment of light distribution and allowing for precise adjustment of light distribution. In particular, the vehicle lighting device in the embodiment (lamp unit 1 for concentrating light and lamp unit 101 for diffusion) facilitates adjustment of light distribution and allows for precise adjustment of light distribution. Thus, the device is effective in the cases where the horizontal cutoff line CL1 and the oblique cutoff line CL2 are present in the light distribution pattern SP for concentrating light formed by one lamp unit 1 for concentrating light and a horizontal cutoff line CL101 is present in the light distribution pattern WP for diffusion formed by the lamp unit 101 for diffusion. In other words, it is effective to define the horizontal cutoff line CL1 and the oblique cutoff line CL2 of the light distribution pattern SP for concentrating light as a standard because it is possible to prevent misidentification between the horizontal cutoff line CL1 and the oblique cutoff line 101 of the light distribution pattern SP for concentrating light and the horizontal cutoff line CL1 of the light distribution pattern WP for diffusion and to prevent stray light exerted by misidentification of the cutoff lines.

Figure 13:
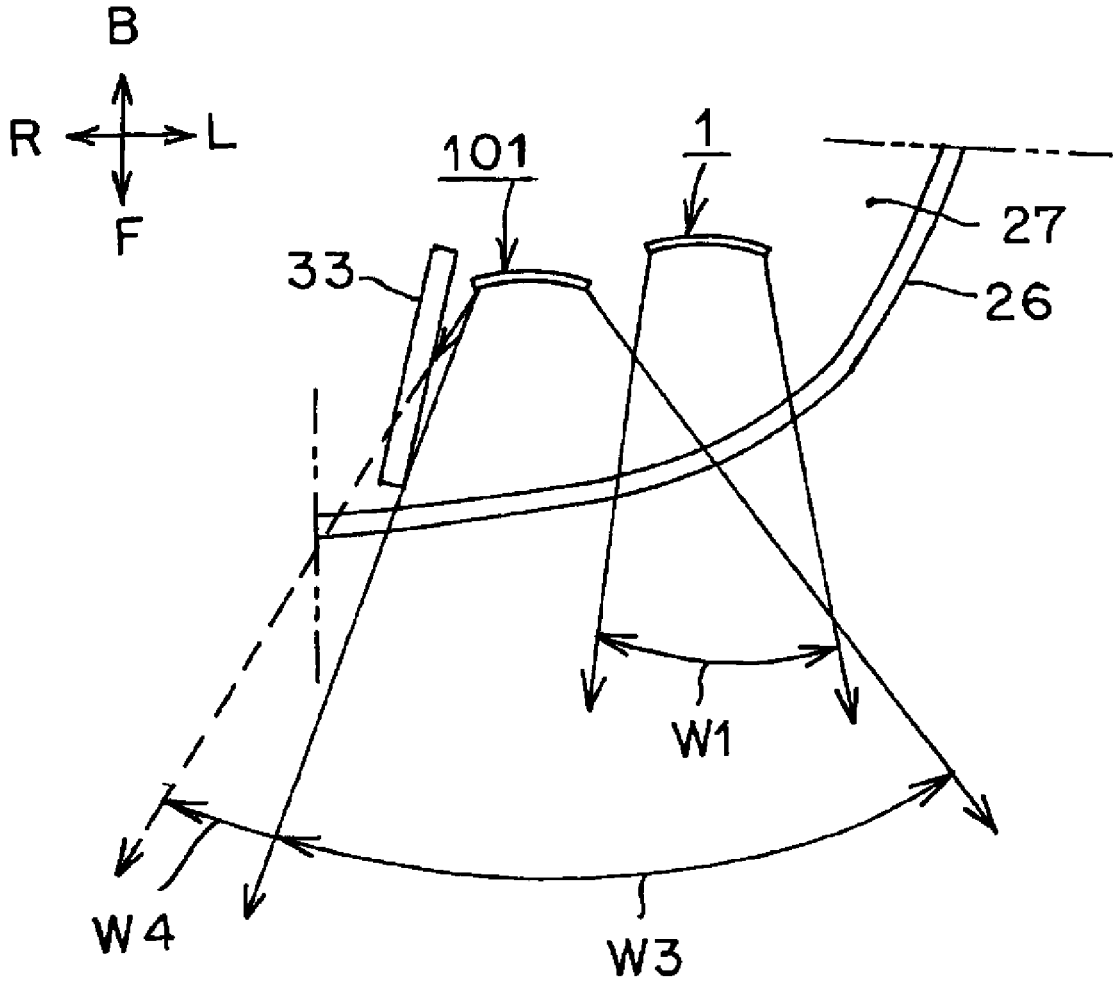
FIG. 13 is a schematic view for explaining a state in which the lamp unit for diffusion is positioned inside of the vehicle relative to the lamp unit for concentrating light.
Figure 14:
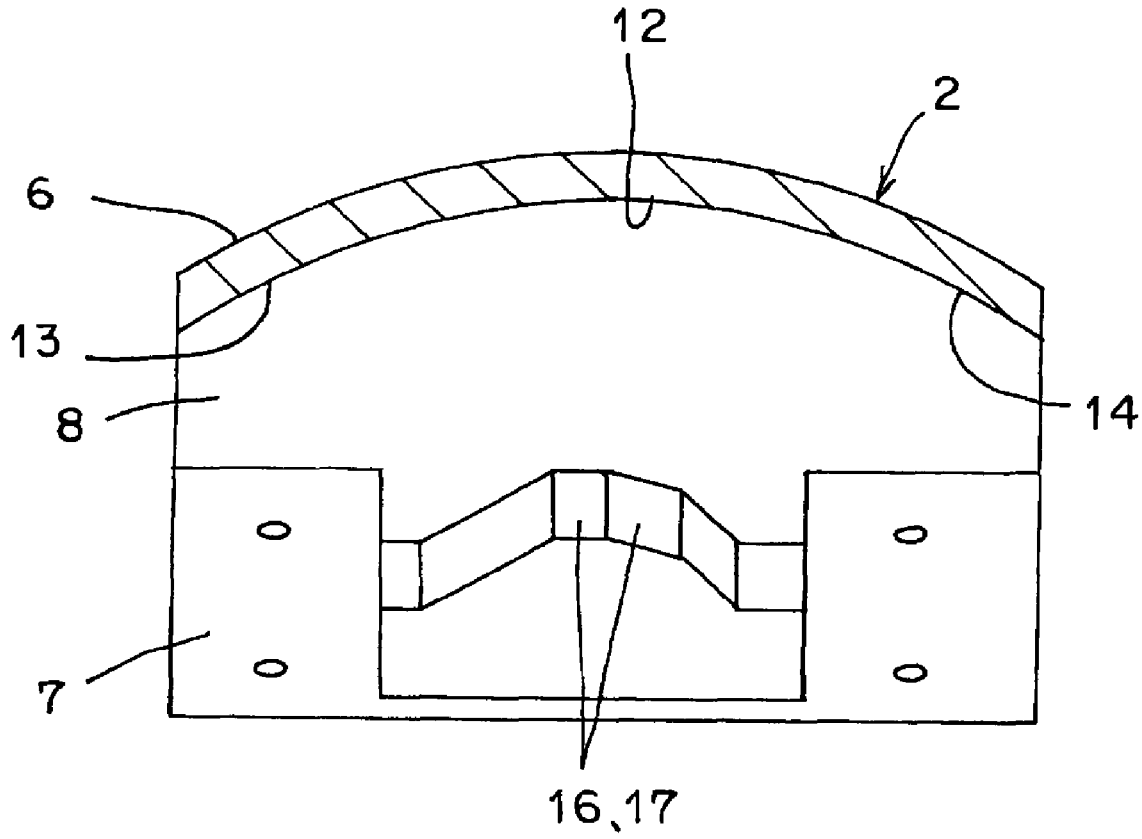
FIG. 14 is a cross section taken along the line XIV-XIV in FIG. 2.

In the vehicle lighting device (lamp unit 1 for concentrating light and lamp unit 101 for diffusion) of the embodiment, as shown in FIGS. 1 and 12, the lamp unit 1 for concentrating light is positioned inside of the vehicle relative to the lamp unit 101 for diffusion. Thus, this lamp unit is effective in a case where an obstacle such as the inner panel 33 exists inside of the vehicle. In other words, the widening range W1 of the light distribution pattern SP for concentrating light, radiated from the lamp unit 1 for concentrating light, is narrower than the widening range W2 of the light distribution pattern WP for diffusion, radiated from the lamp unit 101 for diffusion. Thus, the light distribution pattern SP for concentrating light, radiated from the lamp unit 1 for concentrating light, and the light distribution pattern WP for diffusion, radiated from the lamp unit 101 for diffusion, are never interrupted by an obstacle such as the inner panel 33 positioned inside of the vehicle. Therefore, the widening range W1 of the light distribution pattern SP for concentrating light, radiated from the lamp unit 1 for concentrating light, and the widening range W2 of the distribution pattern WP for diffusion, radiated from the lamp unit 101 for diffusion, are never narrowed by an obstacle such as the inner panel 33 positioned inside of the vehicle. Conversely, as shown in FIG. 13, the lamp unit 101 for diffusion may be positioned inside of the vehicle relative to the lamp unit 1 for concentrating light. In this case, the light distribution pattern SP for concentrating light, radiated from the lamp unit 1 for concentrating light, is never interrupted by an obstacle such as the inner panel 33 positioned inside the vehicle, whereas the light distribution pattern WP for diffusion, radiated from the lamp unit 101 for diffusion, is thereby interrupted. Therefore, the widening range W1 of the light distribution pattern SP for concentrating light, radiated from the lamp unit 1 for concentrating light, is never narrowed by an obstacle such as the inner panel 33 positioned inside of the vehicle, whereas the widening range W3 of the light distribution pattern WP for diffusion, radiated from the lamp unit 101 for diffusion, is narrowed by a range W4 interrupted by an obstacle such as the inner panel 33 positioned inside of the vehicle. In other words, W3=W2−W4 is established. For example, even if the light distribution pattern SP for concentrating light, radiated from the lamp unit 1 for concentrating light, positioned inside of the vehicle, is interrupted by an obstacle such as the inner panel 33 positioned inside of the vehicle, a range (not shown) in which the light distribution pattern SP for concentrating light is interrupted becomes narrower than the range W4 in which the light distribution pattern WP for diffusion, radiated from the lamp unit 101 for diffusion, is interrupted by an obstacle such as the inner panel 33 positioned inside of the vehicle. Even if the light distribution pattern WP for diffusion, radiated from the lamp unit 101 for diffusion, positioned outside of the vehicle, is interrupted by an obstacle such as the inner panel 33 positioned inside of the vehicle, the range (not shown) in which the light distribution pattern WP for diffusion is interrupted becomes narrower than the range W4 in which the light distribution pattern WP for diffusion, radiated from the lamp unit 101 for diffusion, positioned inside of the vehicle is interrupted by an obstacle such as the inner panel 33 positioned inside of the vehicle. This narrowing is effective because it is possible to narrow the range of the light distribution pattern SP for concentrating light, interrupted by an obstacle such as the inner panel 33 positioned inside of the vehicle, and the range of the light distribution pattern WP for diffusion, and it is possible to improve efficiency of light distribution accordingly.

Further, in the vehicle lighting device of the embodiment (lamp unit 1 for concentrating light and lamp unit 101 for diffusion), the parts L3, L103 of the rays of the reflected light L2, L102 from the first reflecting surfaces 11, 111 of the lamp unit 1 for concentrating light and the lamp unit 101 for diffusion are cut off by the shades 16, 116. Thus, the light distribution pattern SP for concentrating light, having the horizontal cutoff line CL1 and the oblique cutoff line CL2, and the light distribution pattern WP for diffusion having the horizontal cutoff line CL101, i.e., the light distribution pattern LP for passing, having the horizontal cutoff lines CL1, CL101, and the oblique cutoff line CL2, can be easily controlled by the second reflecting surfaces 12, 112, the third reflecting surfaces 13, 113, and the fourth reflecting surfaces 14, 114, which are the parabolic reflecting surfaces of the lamp unit 1 for concentrating light and the lamp unit 101 for diffusion. Moreover, in the vehicle lighting device of the embodiment (lamp unit 1 for concentrating light and lamp unit 101 for diffusion), the parts L3, L103 of the rays of the reflected light L2, L102 from the first reflecting surfaces 11, 111, cut off by the shades 16, 116, are reflected by the second reflecting surfaces 12, 112, the third reflecting surfaces 13, 113, and the fourth reflecting surfaces 14, 114, all of which are the parabolic reflecting surfaces, by means of the shade reflecting surfaces 17, 117, so that the rays of the light L1, L101 that are radiated from the semiconductor-type light sources 3, 103 can be effectively utilized. Therefore, in the vehicle lighting device of the embodiment (lamp unit 1 for concentrating light and lamp unit 101 for diffusion), an ideal light distribution pattern LP for passing can be obtained by one lamp unit 1 for concentrating light and one lamp unit 101 for diffusion, making it possible to contribute to traffic safety.

Furthermore, in the vehicle lighting device of the embodiment (lamp unit 1 for concentrating light and lamp unit 101 for diffusion), as shown in FIG. 11, the horizontal cutoff line CL101 of the light distribution pattern WP for diffusion is set lower than the cutoff line CL1 of the light distribution pattern SP for concentrating light. Thus, even in a case where production tolerance occurs with constituent elements of the vehicle lighting device, the horizontal cutoff line CL101 of the light distribution pattern WP for diffusion is never upper than the cutoff line CL1 of the light distribution pattern SP for concentrating light, thus improving the yields and reducing manufacturing cost accordingly. As shown in FIG. 15, the horizontal cutoff lines CL101, CL1 of the light distribution patterns WP and SP for diffusion and for concentrating light may be set at the same horizontal position.

In particular, in the vehicle lighting device of the embodiment (lamp unit 1 for concentrating light and lamp unit 101 for diffusion), as shown in FIGS. 1, 2, 4, 6, 8, and 10, the second reflecting surfaces 12, 112, the third reflecting surfaces 13, 113, and the fourth reflecting surfaces 14, 114, all of which are the parabolic reflecting surfaces, are longitudinally divided, so that longitudinal steps 24, 124 are formed between the second reflecting surfaces 12, 112 and the third reflecting surfaces 13, 113, and between the third reflecting surfaces 13, 113 and the fourth reflecting surfaces 14, 114, respectively. Therefore, in the vehicle lighting device of the embodiment (lamp unit 1 for concentrating light and lamp unit 101 for diffusion), if the rays of the reflected light L2, L102 from the first reflecting surfaces 11, 111 and the rays of the reflected light L4, L104 from the shade reflecting surfaces 17, 117 are incident to the longitudinal steps 24, 124, the rays of the incident light are reflected in the lateral direction, i.e., in the transverse direction at the steps 24, 124. As a result, the vehicle lighting device of the embodiment (lamp unit 1 for concentrating light and lamp unit 101 for diffusion) can prevent vertical stray light in comparison with a vehicle lighting device in which the rays of the reflected light L2, L102 from the first reflecting surfaces 11, 111 and the rays of the reflected light L4, L104 from the shade reflecting surfaces 17, 117 are incident to the lateral steps between the plurality of parabolic reflecting surfaces which are laterally divided, and the rays of the incident reflected light are reflected in the longitudinal direction, i.e., in the vertical direction at the steps. Therefore, in the vehicle lighting device of the embodiment (lamp unit 1 for concentrating light and lamp unit 101 for diffusion), an ideal light distribution pattern, i.e., a light distribution pattern LP for passing can be obtained by one lamp unit 1 for concentrating light and one lamp unit 101 for diffusion, making it possible to contribute to traffic safety. In particular, the vehicle lighting device of the embodiment (lamp unit 1 for concentrating light and lamp unit 101 for diffusion) is effective in a case where a light distribution pattern is the light distribution pattern LP for passing because the device can prevent vertical stray light.

In the vehicle lighting device of the embodiment (lamp unit 1 for concentrating light and lamp unit 101 for diffusion), the third reflecting surfaces 13, 113 at the opposite lane side (right side) are positioned at the light reflecting direction (front side) relative to the second reflecting surfaces 12, 112 at the driving lane side (left side). In addition, the second reflecting surfaces 13, 113 at the opposite lane side (right side) are positioned in the light reflecting direction (front side) relative to the fourth reflecting surfaces 14, 114 at the driving lane side (left side). Therefore, in the vehicle lighting device of the embodiment (lamp unit 1 for concentrating light and lamp unit 101 for diffusion), the longitudinal steps 24, 124 between the second reflecting surfaces 12, 112 and the third reflecting surfaces 13, 113 longitudinally divided, between the second reflecting surfaces 12, 112 and the third reflecting surfaces 13, 113 longitudinally divided, and between the third reflecting surfaces 13, 113 and the fourth reflecting surfaces 14, 114 are oriented to the driving lane side (left side). For this reason, in the vehicle lighting device of the embodiment (lamp unit 1 for concentrating light and lamp unit 101 for diffusion), the rays of the reflected light L2, L102 from the first reflecting surfaces 11, 111 and the rays of the reflected light L4, L104 from the shade reflecting surfaces 17, 117 are incident to the longitudinal steps 24, 124, and the rays of the reflected light are reflected in the lateral direction and in the direction of the driving lane side (left side) at the steps 24, 124. This range is positioned upper than the horizontal cutoff line CL1 of the light distribution pattern LP for passing and more leftward than the oblique cutoff line CL2. As a result, the vehicle lighting device of the embodiment (lamp unit 1 for concentrating light) can prevent stray light in the lateral direction and in the direction of the opposite lane side (right side). This range is positioned upper than the horizontal cutoff line CL1 of the light distribution pattern LP for passing and more rightward than the oblique cutoff line CL2. Therefore, in the vehicle lighting device of the embodiment (lamp unit 1 for concentrating light and lamp unit 101 for diffusion), a further ideal light distribution pattern LP for passing can be obtained by one lamp unit 1 for concentrating light and one lamp unit 101 for diffusion, making it possible to further contribute to traffic safety. In particular, the vehicle lighting device of the embodiment (lamp unit 1 for concentrating light and lamp unit 101 for diffusion) is effective in a case in which a light distribution pattern is the light distribution pattern LP for passing because the device can prevent stray light in the lateral direction and in the direction of the opposite lane (right side).

Further, in the vehicle lighting device of the embodiment (lamp unit 1 for concentrating light and lamp unit 101 for diffusion), optical parts such as the first reflecting surfaces 11, 111, the second reflecting surfaces 12, 112, the third reflecting surfaces 13, 113, the fourth reflecting surfaces 14, 114, the fifth reflecting surfaces 15, 115, the shades 16, 116, and shade reflecting surfaces 17, 117 are integrally constituted at the reflectors 2, 102 that is integrally made up of the elliptical portions 5, 105, the parabolic portions 6, 106, the inclined portions 7, 107, and the horizontal portions 8, 108. For this reason, in the vehicle lighting device of the embodiment (lamp unit 1 for concentrating light and lamp unit 101 for diffusion), the number of parts and man-hour for assembling can be reduced, and manufacturing cost can be reduced accordingly. Moreover, the vehicle lighting device of the embodiment (lamp unit 1 for concentrating light) improves precision among optical parts such as the first reflecting surfaces 11, 111, the second reflecting surfaces 12, 112, the third reflecting surfaces 13, 113, the fourth reflecting surfaces 14, 114, the fifth reflecting surfaces 15, 115, the shades 16, 116, and the shade reflecting surfaces 17, 117. Thus, an optical position relationship between the optical parts is determined, optical adjustment is eliminated, and a light distribution pattern can be controlled with high precision accordingly.

Hereinafter, examples other than the foregoing embodiment will be explained. In the embodiment, the light distribution pattern SP for concentrating light, of the light distribution pattern LP for passing, was formed by the lamp unit 1 for concentrating light, and the light distribution pattern WP for diffusion, of the light distribution pattern LP for passing, was formed by the lamp unit 101 for diffusion. However, in the present invention, predetermined light distribution patterns, which are formed by the light distribution pattern SP for concentrating light of the lamp unit 1 for concentrating light and the light distribution pattern WP for diffusion of the lamp unit 101 for diffusion, may be light distribution patterns other than the light distribution pattern LP for passing, for example, a light distribution pattern for driving, a light distribution pattern for expressway, a light distribution pattern for fog lamp, a light distribution pattern for rain, and a light distribution pattern for additional lamp.

In the embodiment, the third reflecting surfaces 13, 113 at the opposite lane side (right side) was positioned at the light reflecting direction (front side) relative to the second reflecting surfaces 12, 112 at the driving lane side (left side), and further, the second reflecting surfaces 12, 112 at the opposite lane side (right side) was positioned at the light reflecting direction (front side) relative to the fourth reflecting surfaces 14, 114 at the driving lane side (left side). However, in the present invention, the second, third, and fourth reflecting surfaces, 12, 112, 13, 113, and 14, 114 may not be positioned stepwise in front and in the rear.

Further, in the embodiment, the parabolic reflecting surfaces were longitudinally divided into three sections, thereby constituting the second, third, and fourth reflecting surfaces 12, 112, 13, 113, and 14, 114. However, in the present invention, the parabolic reflecting surfaces may be longitudinally divided into two sections or four or more sections.

Still furthermore, in the embodiment, the shades 16, 116 were provided and the shade reflecting surfaces 17, 117 were provided thereon. However, in the present invention, the shades 16, 116 may not be provided, or alternatively, the shade reflecting surfaces 17, 117 may not be provided thereon.

Yet furthermore, in the embodiment, the fifth reflecting surface 15 that is the parabolic reflecting surface for overhead sign was provided upwardly of the second, third, and fourth reflecting surfaces 12, 13, and 14 divided longitudinally of the lamp unit 1 for concentrating light. However, in the present invention, the fifth reflecting surface may be provided upwardly of the second, third, and fourth reflecting surfaces 112, 113, and 114 of the lamp unit 101 for diffusion. The fifth reflecting surface 15 may not be provided upwardly of the second, third, and fourth reflecting surfaces 12, 13, and 14 of the lamp unit 1 for concentrating light, or alternatively, the light distribution pattern OP for overhead sign, shown in FIG. 15, may not be formed.

What is claimed is:

1. A vehicle lighting device, comprising:

a lamp unit for concentrating light;

a lamp unit for diffusion;

a lamp housing and a lamp lens, partitioning a lamp room; and an optical-axis adjuster which is integrally mounted in the lamp housing in an optical-axis adjustable manner in a state in which the lamp unit for concentrating light and the lamp unit for diffusion are integrally disposed in the lamp room, wherein the lamp unit for concentrating light is comprised of:

a first reflecting surface which is an elliptical reflecting surface;

a semiconductor-type light source disposed at or near a first focal point of the first reflecting surface; and a parabolic reflecting surface for controlling reflected light from the first reflecting surface and reflecting the controlled reflected light on a road surface, as a light distribution pattern for concentrating light, and wherein:

the lamp unit for diffusion is comprised of:

a first reflecting surface which is an elliptical reflecting surface;

a semiconductor-type light source disposed at or near a first focal point of the first reflecting surface; and a parabolic reflecting surface for controlling reflected light from the first reflecting surface and reflecting the controlled reflected light on a road surface, as a light distribution pattern for diffusion.

2. The vehicle lighting device according to claim 1, wherein:

the lamp unit for concentrating light is positioned inside of a vehicle relative to the lamp unit for diffusion.

3. The vehicle lighting device according to claim 1, wherein:

the lamp unit for concentrating light comprises:

a shade which is provided at or near a second focal point of the first reflecting surface and cuts off part of reflected light from the first reflecting surface;

a shade reflecting surface which is provided on the shade and reflects on the parabolic reflecting surface the part of the reflected light from the first reflecting surface, the reflected light being cut off by the shade; and the parabolic reflecting surface, a focal point of which is positioned at or near the second focal point of the first reflecting surface and which controls the reflected light from the first reflecting surface and the reflected light from the shade reflecting surface and reflects the controlled reflected light on a road surface, as the light distribution pattern for concentrating light having a horizontal cutoff line and an oblique cutoff line, and wherein:

the lamp unit for diffusion comprises:

a shade which is provided at or near a second focal point of the first reflecting surface and cuts off part of reflected light from the first reflecting surface;

a shade reflecting surface which is provided on the shade and reflects on the parabolic reflecting surface the part of the reflected light from the first reflecting surface, the reflected light being cut off by the shade; and the parabolic reflecting surface, a focal point of which is positioned at or near the second focal point of the first reflecting surface and which controls the reflected light from the first reflecting surface and the reflected light from the shade reflecting surface and reflects the controlled reflected light on a road surface, as the light distribution pattern for concentrating light having a horizontal cutoff line.

4. The vehicle lighting device according to claim 3, wherein:

the horizontal cutoff line of the light distribution pattern for diffusion is set lower than the horizontal cutoff line of the light distribution pattern for concentrating light.

* * * * *